US012680556B2

(12) United States Patent
Huang et al.

(10) Patent No.: US 12,680,556 B2
(45) Date of Patent: Jul. 14, 2026

(54) DIVERSIFIED AND REMOVABLE PUMP SYSTEMS AND METHODS FOR INFLATING AND DEFLATING INFLATABLE OBJECTS

(71) Applicant: Intex Marketing Ltd., Tortola (VG)

(72) Inventors: Zhi Xiong Huang, Fujian (CN); Huai Tian Wang, Fujian (CN); Zhi Wen Zhou, Fujian (CN)

(73) Assignee: Intex Marketing Ltd., Tortola (VG)

( * ) Notice: Subject to any disclaimer, the term of this patent is extended or adjusted under 35 U.S.C. 154(b) by 587 days.

(21) Appl. No.: 17/625,060

(22) PCT Filed: Jul. 6, 2020

(86) PCT No.: PCT/IB2020/056351

§ 371 (c)(1),
(2) Date: Jan. 5, 2022

(87) PCT Pub. No.: WO2021/005495

PCT Pub. Date: Jan. 14, 2021

(65) Prior Publication Data

US 2022/0282734 A1 Sep. 8, 2022

(30) Foreign Application Priority Data

Jul. 5, 2019 (CN) ..... 201921040823.1
Jul. 5, 2019 (CN) ..... 201921041113.0
(Continued)

(51) Int. Cl.
*F04D 29/52* (2006.01)
*A47C 27/08* (2006.01)
(Continued)

(52) U.S. Cl.
CPC ..... *F04D 29/524* (2013.01); *F04D 29/002* (2013.01); *F04D 29/403* (2013.01);
(Continued)

(58) Field of Classification Search
CPC ..... F04D 25/06; F04D 29/522; F04D 29/403; F04D 29/524; F04D 29/602; F04D 29/002; F04D 29/64; A47C 27/081; A47C 27/082
See application file for complete search history.

(56) References Cited

U.S. PATENT DOCUMENTS 388,037 A 8/1888 Hargin
1,198,687 A 9/1916 Williams et al.
(Continued)

FOREIGN PATENT DOCUMENTS

CN 1391866 A 1/2003
CN 1490529 A 4/2004
(Continued)

OTHER PUBLICATIONS

International Preliminary Report on Patentability received for PCT Patent Application No. PCT/IB2020/056351, mailed on Jan. 20, 2022, 8 pages.
(Continued)

*Primary Examiner* — Christopher S Bobish
(74) *Attorney, Agent, or Firm* — Faegre Drinker Biddle & Reath LLP

(57) ABSTRACT

The present disclosure relates to pump systems having multiple, diverse applications and uses for use with inflatable products. Specifically, the present disclosure relates to pump systems where inflation or deflation of the associated inflatable product may be accomplished in more than one way while using a single pump. For example, by utilizing electronic means or, alternatively, manual means to inflate or deflate an inflatable product.

18 Claims, 27 Drawing Sheets

(30) Foreign Application Priority Data

| | | |
|---|---|---|
| Jul. 5, 2019 | (CN) | 201921041114.5 |
| Feb. 26, 2020 | (CN) | 202020213452.9 |
| Mar. 19, 2020 | (CN) | 202020352250.2 |
| Apr. 3, 2020 | (CN) | 202020478355.2 |

(51) Int. Cl.

| | |
|---|---|
| ***F04D 25/06*** | (2006.01) |
| ***F04D 29/00*** | (2006.01) |
| ***F04D 29/40*** | (2006.01) |
| ***F04D 29/60*** | (2006.01) |
| ***F04D 29/64*** | (2006.01) |

(52) U.S. Cl.

CPC ..... *F04D 29/602* (2013.01); *F04D 29/64* (2013.01); *A47C 27/081* (2013.01); *F04D 25/06* (2013.01); *F04D 29/522* (2013.01)

(56) References Cited

U.S. PATENT DOCUMENTS

| | | | | |
|---|---|---|---|---|
| 1,772,310 | A | 8/1930 | Hart | |
| 2,684,860 | A | 7/1954 | Rafferty | |
| 2,926,836 | A | 3/1960 | Oliver et al. | |
| 3,155,991 | A | 11/1964 | Dunham | |
| 3,185,503 | A | 5/1965 | Angle | |
| 3,388,701 | A | 6/1968 | Peter et al. | |
| 3,462,778 | A | 8/1969 | Whitney | |
| 3,596,936 | A | 8/1971 | Dieckmann et al. | |
| 3,876,234 | A | 4/1975 | Harms | |
| 4,193,149 | A | 3/1980 | Welch | |
| 4,197,837 | A | 4/1980 | Christoffel et al. | |
| 4,225,989 | A | 10/1980 | Corbett et al. | |
| 4,504,989 | A | 3/1985 | Maltz | |
| 4,583,255 | A | 4/1986 | Mogaki et al. | |
| 4,619,481 | A | 10/1986 | Grudzinskas | |
| 4,638,519 | A | 1/1987 | Hess | |
| 4,644,597 | A | 2/1987 | Walker | |
| 4,711,275 | A | 12/1987 | Ford et al. | |
| 4,768,249 | A | 9/1988 | Goodwin | |
| 4,829,616 | A | 5/1989 | Walker | |
| 4,890,344 | A | 1/1990 | Walker | |
| 4,897,890 | A | 2/1990 | Walker | |
| 4,944,060 | A | 7/1990 | Peery et al. | |
| 4,945,588 | A | 8/1990 | Cassidy et al. | |
| 5,009,252 | A | 4/1991 | Faughn | |
| 5,020,176 | A | 6/1991 | Dotson | |
| 5,023,967 | A | 6/1991 | Ferrand | |
| 5,044,029 | A | 9/1991 | Vrzalik | |
| 5,138,729 | A | 8/1992 | Ferrand | |
| 5,142,717 | A | 9/1992 | Everard et al. | |
| 5,189,742 | A | 3/1993 | Schild | |
| 5,232,353 | A | 8/1993 | Grant | |
| 5,235,713 | A | 8/1993 | Guthrie et al. | |
| 5,249,319 | A | 10/1993 | Higgs | |
| 5,267,363 | A | 12/1993 | Chaffee | |
| 5,279,010 | A | 1/1994 | Ferrand et al. | |
| 5,323,500 | A | 6/1994 | Roe et al. | |
| 5,345,629 | A | 9/1994 | Ferrand | |
| 5,349,983 | A | 9/1994 | Ozarowski et al. | |
| 5,354,117 | A | 10/1994 | Danielson et al. | |
| 5,367,726 | A | 11/1994 | Chaffee | |
| 5,509,154 | A | 4/1996 | Shafer et al. | |
| 5,584,084 | A | 12/1996 | Klearman et al. | |
| 5,588,811 | A | 12/1996 | Price | |
| 5,606,756 | A | 3/1997 | Price | |
| 5,652,484 | A | 7/1997 | Shafer et al. | |
| 5,711,041 | A | 1/1998 | Chen | |
| 5,716,199 | A | 2/1998 | Shan-Chieh | |
| 5,802,640 | A | 9/1998 | Ferrand et al. | |
| 5,898,958 | A | 5/1999 | Hall | |
| 5,903,941 | A | 5/1999 | Shafer et al. | |
| 5,904,172 | A | 5/1999 | Gifft et al. | |
| 5,906,016 | A | 5/1999 | Ferrand et al. | |
| 5,906,017 | A | 5/1999 | Ferrand et al. | |
| 5,944,494 | A | 8/1999 | Soltani et al. | |
| 5,970,550 | A | 10/1999 | Gazes | |
| 6,032,080 | A | 2/2000 | Brisbane et al. | |
| 6,037,723 | A | 3/2000 | Shafer et al. | |
| 6,058,537 | A | 5/2000 | Larson | |
| 6,120,264 | A | 9/2000 | Wang | |
| 6,152,176 | A | 11/2000 | Lin | |
| 6,158,082 | A | 12/2000 | Beckey et al. | |
| 6,185,770 | B1 | 2/2001 | Wang | |
| 6,206,654 | B1 | 3/2001 | Cassidy | |
| 6,212,718 | B1 | 4/2001 | Stolpmann et al. | |
| 6,219,868 | B1 | 4/2001 | Wang | |
| 6,253,401 | B1 | 7/2001 | Boyd | |
| 6,253,402 | B1 | 7/2001 | Lin | |
| 6,266,833 | B1 | 7/2001 | Lin | |
| 6,332,760 | B1 | 12/2001 | Chung | |
| 6,447,361 | B1 | 9/2002 | Akiyama | |
| 6,457,197 | B1 | 10/2002 | Wu | |
| 6,483,264 | B1 | 11/2002 | Shafer et al. | |
| 6,543,073 | B2 * | 4/2003 | Wu | A47C 7/021 5/713 |
| 6,564,411 | B2 | 5/2003 | Pirzada | |
| 6,571,825 | B2 | 6/2003 | Stacy | |
| 6,581,223 | B1 | 6/2003 | Wang | |
| 6,591,437 | B1 | 7/2003 | Phillips | |
| 6,623,249 | B1 | 9/2003 | Rogers et al. | |
| 6,679,686 | B2 * | 1/2004 | Wang | F04D 25/084 415/203 |
| 6,686,711 | B2 | 2/2004 | Rose et al. | |
| 6,698,046 | B1 | 3/2004 | Wu | |
| 6,709,246 | B2 | 3/2004 | Boyd | |
| 6,718,584 | B2 | 4/2004 | Rabaiotti et al. | |
| 6,722,306 | B1 | 4/2004 | Wang | |
| 6,733,254 | B1 * | 5/2004 | Yen | F04D 17/16 415/206 |
| 6,754,925 | B1 | 6/2004 | Wang | |
| 6,754,926 | B2 | 6/2004 | Wang | |
| 6,755,208 | B2 | 6/2004 | Chaffee | |
| 6,763,540 | B1 | 7/2004 | Wang | |
| 6,763,541 | B2 | 7/2004 | Mahoney et al. | |
| 6,793,469 | B2 | 9/2004 | Chung | |
| 6,800,165 | B2 | 10/2004 | Wang | |
| 6,832,629 | B2 | 12/2004 | Wu | |
| 6,832,630 | B2 | 12/2004 | Wu | |
| 6,836,914 | B1 | 1/2005 | Tsai | |
| 6,928,681 | B1 | 8/2005 | Stacy | |
| 6,955,527 | B2 * | 10/2005 | Yen | F04B 35/04 417/360 |
| 6,955,529 | B2 | 10/2005 | Tsai | |
| 6,990,700 | B2 | 1/2006 | Chung | |
| 7,020,921 | B2 * | 4/2006 | Wang | A47C 27/082 5/713 |
| 7,025,576 | B2 | 4/2006 | Chaffee | |
| 7,028,358 | B2 | 4/2006 | Liu | |
| 7,036,171 | B2 | 5/2006 | Wu | |
| 7,039,972 | B2 | 5/2006 | Chaffee | |
| 7,040,347 | B2 | 5/2006 | Wang | |
| 7,063,514 | B1 | 6/2006 | Wu | |
| 7,089,618 | B1 | 8/2006 | Metzger | |
| 7,114,204 | B2 | 10/2006 | Patrick | |
| 7,114,207 | B2 | 10/2006 | Wang | |
| 7,120,955 | B2 | 10/2006 | Wang | |
| 7,128,525 | B2 | 10/2006 | Tsai | |
| RE39,408 | E | 11/2006 | Wang | |
| 7,131,701 | B1 | 11/2006 | Yang | |
| 7,141,101 | B2 | 11/2006 | Amann | |
| 7,152,265 | B2 | 12/2006 | Chung | |
| 7,198,076 | B2 * | 4/2007 | Wu | F04D 27/00 141/10 |
| 7,210,902 | B2 | 5/2007 | Song et al. | |
| 7,225,488 | B2 | 6/2007 | Wu | |
| 7,232,376 | B2 | 6/2007 | Droppleman | |
| 7,246,394 | B2 * | 7/2007 | Wang | A47C 27/082 5/713 |
| 7,284,291 | B2 | 10/2007 | Wang | |
| 7,284,968 | B2 * | 10/2007 | Tsai | F04D 29/503 417/423.1 |

(56) References Cited

U.S. PATENT DOCUMENTS 7,306,694 B2 12/2007 Wang
7,313,837 B2 1/2008 Wang
7,322,801 B2 1/2008 Li et al.
7,334,274 B2 2/2008 Wang
7,346,944 B2 3/2008 Shaw
7,346,950 B2 3/2008 Chung
7,365,277 B2 4/2008 Wang
7,380,301 B2 6/2008 Chung
7,387,290 B2 6/2008 Wang
7,406,736 B2 8/2008 Flick
7,426,766 B2 9/2008 Gammons
7,434,283 B2 10/2008 Wilkinson et al.
7,444,704 B2 11/2008 Phillips et al.
7,475,440 B2 1/2009 Chaffee
7,475,443 B2 1/2009 Wang
7,497,416 B2 3/2009 Wang
7,509,698 B2 3/2009 Poulos
7,571,500 B2 8/2009 Wu
7,587,776 B2 9/2009 Poulos
7,588,425 B2 9/2009 Chung
7,597,123 B2 10/2009 Wang
7,647,662 B2 1/2010 Wang
7,648,392 B2 1/2010 Chambers et al.
7,703,160 B2 4/2010 Wang
7,735,164 B1 6/2010 Patrick
7,739,760 B2 6/2010 Wang et al.
7,739,763 B2 6/2010 Wang et al.
7,784,131 B2 8/2010 Genaro et al.
7,784,132 B2 8/2010 Gonzalez et al.
7,789,194 B2 9/2010 Lathrop et al.
7,805,785 B2 10/2010 Rawls-Meehan
7,877,829 B2 2/2011 Gonzalez et al.
7,886,386 B2 2/2011 Balonick et al.
7,922,461 B2 4/2011 Wang
RE42,559 E * 7/2011 Wang ..... F04D 29/601 5/706
7,979,169 B2 7/2011 Rawls-Meehan
8,024,830 B2 9/2011 Wang et al.
8,032,263 B2 10/2011 Rawls-Meehan
8,032,960 B2 10/2011 Rawls-Meehan
8,033,797 B2 10/2011 Kehrmann et al.
8,033,800 B2 10/2011 Pan
8,046,117 B2 10/2011 Rawls-Meehan
8,051,517 B2 11/2011 Wang et al.
8,052,630 B2 11/2011 Kloecker et al.
8,078,336 B2 12/2011 Rawls-Meehan
8,078,337 B2 12/2011 Rawls-Meehan
8,083,396 B2 12/2011 Wang
8,087,113 B2 1/2012 Roff et al.
8,104,126 B2 1/2012 Caminade et al.
8,125,318 B2 2/2012 Heimbrock et al.
8,151,390 B2 4/2012 Wang et al.
8,156,589 B2 4/2012 Liu et al.
8,157,535 B2 * 4/2012 Wang ..... F04B 35/06 417/44.1
8,162,009 B2 4/2012 Chaffee
8,176,588 B2 5/2012 Lin
8,192,298 B2 6/2012 Droppleman
8,210,834 B2 7/2012 Tsai
8,214,953 B2 7/2012 Wang
8,216,290 B2 7/2012 Shawver et al.
8,235,684 B2 8/2012 Song et al.
8,276,222 B1 10/2012 Patrick
8,297,309 B2 10/2012 Wang
8,336,369 B2 12/2012 Mahoney
8,348,207 B2 1/2013 Wang et al.
8,413,278 B2 4/2013 Chaffee
8,444,103 B2 5/2013 Wang et al.
8,480,375 B2 7/2013 Tsai
8,549,686 B2 10/2013 Wang et al.
8,561,230 B2 10/2013 Shaw
8,636,481 B2 * 1/2014 Liu ..... F04D 25/084 251/263
8,641,391 B2 2/2014 Pan
8,646,812 B2 2/2014 Chien et al.
8,656,539 B1 2/2014 Boyd
8,671,487 B2 3/2014 Dewell
8,678,007 B2 3/2014 Porter, III
8,682,457 B2 3/2014 Rawls-Meehan
8,696,322 B2 4/2014 Kehrmann et al.
8,707,488 B2 4/2014 Riley et al.
8,745,796 B2 6/2014 Liu
8,769,747 B2 7/2014 Mahoney et al.
8,801,392 B2 8/2014 Wang et al.
8,832,886 B2 9/2014 Riley et al.
8,839,473 B1 9/2014 Catala
8,839,474 B2 9/2014 Chaffee
8,863,771 B2 10/2014 Wang et al.
8,887,326 B2 11/2014 Patrick
8,893,339 B2 11/2014 Fleury et al.
8,894,390 B2 11/2014 Hsu
8,905,981 B2 12/2014 Budig et al.
8,910,331 B2 12/2014 Wang et al.
8,931,329 B2 1/2015 Mahoney
8,961,145 B2 2/2015 Hill et al.
8,966,689 B2 3/2015 Mcguire et al.
9,033,678 B2 5/2015 Tsai
9,057,656 B2 6/2015 Chen
9,062,668 B2 6/2015 Wang et al.
9,114,048 B2 8/2015 Takeda et al.
9,121,519 B2 9/2015 Wang et al.
9,125,777 B2 9/2015 Patrick
9,127,798 B2 9/2015 Wu
9,157,433 B2 10/2015 Wang et al.
9,211,018 B2 * 12/2015 Wang ..... F04D 29/503
9,211,019 B2 12/2015 Driscoll et al.
9,241,580 B2 1/2016 Patrick et al.
9,279,510 B2 3/2016 Chaffee
9,289,073 B2 3/2016 Chaffee
9,295,336 B2 3/2016 Driscoll et al.
9,314,105 B2 4/2016 Ralws-Meehan
9,314,388 B2 4/2016 Patrick
9,345,335 B2 5/2016 Giori et al.
9,364,386 B2 6/2016 Siegner
9,371,828 B2 6/2016 Tsai
9,371,837 B2 6/2016 Tsai
9,395,076 B2 7/2016 Wang et al.
9,541,096 B2 * 1/2017 Tsai ..... F04D 27/001
9,622,589 B2 4/2017 Nomura et al.
9,719,541 B2 8/2017 De Grasse
9,729,430 B2 8/2017 Weinstein
9,737,153 B2 8/2017 Chaffee
9,775,443 B2 10/2017 Spahn et al.
9,848,706 B2 12/2017 Wang et al.
9,879,682 B1 1/2018 Beliveau et al.
9,913,547 B2 3/2018 Driscoll et al.
9,989,979 B2 6/2018 Wang et al.
10,085,569 B2 10/2018 Liu et al.
10,104,967 B2 10/2018 Wang et al.
10,227,972 B2 3/2019 Shao
10,273,966 B2 * 4/2019 Lau ..... F04D 25/06
10,443,602 B2 * 10/2019 Liu ..... F04D 29/083
10,502,218 B2 12/2019 Liu
10,570,911 B2 2/2020 Lau et al.
10,677,232 B2 6/2020 Shakal et al.
10,709,255 B2 7/2020 Huang et al.
10,716,408 B2 7/2020 Yang
10,808,710 B2 10/2020 Huang et al.
10,813,470 B2 10/2020 Mahoney et al.
10,837,452 B2 11/2020 Huang et al.
10,851,795 B2 12/2020 Lin et al.
10,851,796 B2 12/2020 Li
10,888,173 B2 1/2021 Shakal
11,058,226 B2 7/2021 Hsu et al.
11,268,529 B2 3/2022 Huang et al.
11,339,792 B2 5/2022 Li
11,384,769 B2 7/2022 Huang et al.
11,549,514 B2 1/2023 Huang et al.
11,668,310 B2 6/2023 Huang et al.
11,672,715 B2 6/2023 Dzioba et al.
11,680,573 B2 * 6/2023 Huang ..... A47C 27/082 417/423.14
11,686,299 B2 6/2023 Huang et al.
11,703,059 B2 7/2023 Huang et al.

(56) References Cited

U.S. PATENT DOCUMENTS

| | | | |
|---|---|---|---|
| 11,767,855 | B2 | 9/2023 | Yang |
| 11,793,321 | B2 | 10/2023 | Lau et al. |
| 11,832,728 | B2 | 12/2023 | Doffing et al. |
| 11,846,359 | B2 | 12/2023 | Huang |
| 11,849,854 | B2 | 12/2023 | Ocegueda et al. |
| 11,889,928 | B2 | 2/2024 | Karschnik et al. |
| 11,896,139 | B2 | 2/2024 | Palashewski et al. |
| 11,910,930 | B2 | 2/2024 | Shi |
| 11,940,142 | B1 | 3/2024 | Chen |
| 11,988,216 | B2 | 5/2024 | Li |
| 11,994,139 | B2 | 5/2024 | Huang et al. |
| 12,161,228 | B2 | 12/2024 | Driscoll et al. |
| 12,221,969 | B2 | 2/2025 | Huang et al. |
| 12,253,143 | B2 | 3/2025 | Chang et al. |
| 12,274,369 | B2 | 4/2025 | Nunn et al. |
| 12,290,181 | B2 | 5/2025 | Shakal |
| 2001/0044969 | A1 | 11/2001 | Chaffee |
| 2003/0159218 | A1 | 8/2003 | Lin et al. |
| 2004/0037717 | A1 | 2/2004 | Wang |
| 2005/0079010 | A1 | 4/2005 | Droppleman |
| 2005/0079077 | A1 | 4/2005 | Tsai et al. |
| 2006/0117488 | A1 | 6/2006 | Hung et al. |
| 2006/0162779 | A1 | 7/2006 | Chaffee |
| 2006/0198741 | A1* | 9/2006 | Wu ..... F04D 25/084 417/406 |
| 2006/0204361 | A1 | 9/2006 | Xie |
| 2006/0222535 | A1 | 10/2006 | Liu |
| 2006/0291964 | A1 | 12/2006 | Wang |
| 2007/0006387 | A1 | 1/2007 | Wang |
| 2007/0033738 | A1 | 2/2007 | Tu |
| 2007/0209119 | A1 | 9/2007 | Chun-Chu |
| 2007/0212242 | A1 | 9/2007 | Chen |
| 2008/0109958 | A1 | 5/2008 | Wang et al. |
| 2008/0201857 | A1 | 8/2008 | Kelly |
| 2008/0232982 | A1 | 9/2008 | Boyd et al. |
| 2010/0089458 | A1 | 4/2010 | Chaffee |
| 2010/0170044 | A1 | 7/2010 | Kao et al. |
| 2010/0247337 | A1 | 9/2010 | Tsai |
| 2010/0247355 | A1 | 9/2010 | Pan |
| 2010/0247356 | A1* | 9/2010 | Tsai ..... F04D 29/602 417/423.14 |
| 2011/0073202 | A1 | 3/2011 | Feingold et al. |
| 2011/0158834 | A1* | 6/2011 | Pan ..... F04D 25/0673 417/423.14 |
| 2011/0173758 | A1 | 7/2011 | Fontaine |
| 2011/0259449 | A1 | 10/2011 | Wang et al. |
| 2011/0259453 | A1 | 10/2011 | Coleman et al. |
| 2011/0284108 | A1 | 11/2011 | Wang et al. |
| 2011/0306844 | A1 | 12/2011 | Young |
| 2011/0314612 | A1 | 12/2011 | Hsu |
| 2012/0133182 | A1 | 5/2012 | Chiu |
| 2012/0304391 | A1 | 12/2012 | Driscoll et al. |
| 2012/0317727 | A1 | 12/2012 | Tanaka et al. |
| 2013/0134764 | A1 | 5/2013 | Groh |
| 2013/0230410 | A1 | 9/2013 | Tsai |
| 2014/0090176 | A1 | 4/2014 | Boyd |
| 2014/0188285 | A1 | 7/2014 | Rawls-Meehan |
| 2014/0205123 | A1 | 7/2014 | Lafort et al. |
| 2014/0250597 | A1 | 9/2014 | Chen et al. |
| 2014/0259434 | A1 | 9/2014 | Nunn et al. |
| 2014/0277611 | A1 | 9/2014 | Nunn et al. |
| 2014/0298589 | A1 | 10/2014 | Bailey |
| 2014/0366957 | A1 | 12/2014 | Wang et al. |
| 2015/0026896 | A1 | 1/2015 | Fleury et al. |
| 2015/0082547 | A1 | 3/2015 | Boyd |
| 2015/0082548 | A1 | 3/2015 | Boyd |
| 2015/0089748 | A1 | 4/2015 | Toms et al. |
| 2015/0135444 | A1 | 5/2015 | Spahn et al. |
| 2015/0157137 | A1 | 6/2015 | Nunn et al. |
| 2015/0164236 | A1 | 6/2015 | Driscoll et al. |
| 2015/0182033 | A1 | 7/2015 | Brosnan et al. |
| 2015/0265056 | A1 | 9/2015 | Wang et al. |
| 2015/0308454 | A1 | 10/2015 | Shi |
| 2015/0316067 | A1 | 11/2015 | Tsai |
| 2015/0366368 | A1 | 12/2015 | Cheng |
| 2015/0374137 | A1 | 12/2015 | Mahoney et al. |
| 2016/0106620 | A1 | 4/2016 | Uno et al. |
| 2016/0120331 | A1 | 5/2016 | Wang et al. |
| 2016/0123349 | A1 | 5/2016 | Wang et al. |
| 2016/0215780 | A1 | 7/2016 | Liu |
| 2016/0238000 | A1 | 8/2016 | Suarez |
| 2017/0130728 | A1 | 5/2017 | Liu |
| 2017/0156519 | A1 | 6/2017 | Cheng |
| 2017/0202364 | A1 | 7/2017 | Ohno et al. |
| 2017/0254337 | A1 | 9/2017 | Lau et al. |
| 2017/0274396 | A1 | 9/2017 | Wang et al. |
| 2017/0280884 | A1 | 10/2017 | Liu |
| 2017/0292553 | A1 | 10/2017 | De Grasse |
| 2018/0160820 | A1 | 6/2018 | Hsu et al. |
| 2018/0252232 | A1 | 9/2018 | Shi |
| 2018/0335042 | A1 | 11/2018 | Lin et al. |
| 2019/0075930 | A1 | 3/2019 | Zhang |
| 2019/0211829 | A1 | 7/2019 | Huang et al. |
| 2019/0271323 | A1 | 9/2019 | Huang et al. |
| 2019/0301476 | A1 | 10/2019 | Huang et al. |
| 2019/0387897 | A1 | 12/2019 | Jiang |
| 2020/0132083 | A1 | 4/2020 | Liu |
| 2020/0158101 | A1 | 5/2020 | Yin et al. |
| 2020/0200180 | A1 | 6/2020 | Huang et al. |
| 2020/0248706 | A1 | 8/2020 | Liu |
| 2020/0256345 | A1 | 8/2020 | Huang et al. |
| 2020/0386235 | A1 | 12/2020 | Huang et al. |
| 2020/0386237 | A1 | 12/2020 | Huang et al. |
| 2020/0400149 | A1 | 12/2020 | Huang et al. |
| 2021/0003126 | A1 | 1/2021 | Huang et al. |
| 2021/0018013 | A1 | 1/2021 | Li |
| 2021/0227990 | A1 | 7/2021 | Looslie et al. |
| 2022/0349415 | A1 | 11/2022 | Huang |
| 2023/0093808 | A1 | 3/2023 | Huang et al. |
| 2023/0258199 | A1 | 8/2023 | Huang et al. |
| 2023/0272788 | A1 | 8/2023 | Qin et al. |
| 2023/0323870 | A1 | 10/2023 | Huabin |
| 2023/0389717 | A1 | 12/2023 | Yang et al. |
| 2025/0122881 | A1 | 4/2025 | Huang et al. |

FOREIGN PATENT DOCUMENTS

| | | | |
|---|---|---|---|
| CN | 2611641 | Y | 4/2004 |
| CN | 1519476 | A | 8/2004 |
| CN | 2716554 | Y | 8/2005 |
| CN | 2731153 | Y | 10/2005 |
| CN | 2746161 | Y | 12/2005 |
| CN | 2750081 | Y | 1/2006 |
| CN | 1260478 | C | 6/2006 |
| CN | 1263614 | C | 7/2006 |
| CN | 1928419 | A | 3/2007 |
| CN | 200985892 | Y | 12/2007 |
| CN | 201050491 | Y | 4/2008 |
| CN | 201090463 | Y | 7/2008 |
| CN | 201091399 | Y | 7/2008 |
| CN | 100410545 | C | 8/2008 |
| CN | 101310650 | A | 11/2008 |
| CN | 101319669 | A | 12/2008 |
| CN | 100468596 | C | 3/2009 |
| CN | 101439583 | | 5/2009 |
| CN | 201258841 | Y | 6/2009 |
| CN | 201273290 | | 7/2009 |
| CN | 101509480 | A | 8/2009 |
| CN | 201347870 | | 11/2009 |
| CN | 201372940 | Y | 12/2009 |
| CN | 100593831 | C | 3/2010 |
| CN | 101846054 | A | 9/2010 |
| CN | 201650657 | U | 11/2010 |
| CN | 201679677 | U | 12/2010 |
| CN | 201679704 | U | 12/2010 |
| CN | 102022364 | | 4/2011 |
| CN | 102022365 | A | 4/2011 |
| CN | 201953695 | | 8/2011 |
| CN | 103004731 | A | 4/2013 |
| CN | 103075357 | A | 5/2013 |
| CN | 103119303 | A | 5/2013 |
| CN | 203161593 | U | 8/2013 |
| CN | 103600502 | | 2/2014 |
| CN | 103615402 | A | 3/2014 |

(56) References Cited

FOREIGN PATENT DOCUMENTS

| | | | |
|---|---|---|---|
| CN | 103790848 | A | 5/2014 |
| CN | 203702614 | U | 7/2014 |
| CN | 104441637 | | 3/2015 |
| CN | 104728179 | A | 6/2015 |
| CN | 105283098 | | 1/2016 |
| CN | 205064308 | | 3/2016 |
| CN | 205207134 | U | 5/2016 |
| CN | 205434304 | | 8/2016 |
| CN | 205533335 | U | 8/2016 |
| CN | 105952663 | A | 9/2016 |
| CN | 205744550 | | 11/2016 |
| CN | 205779836 | U | 12/2016 |
| CN | 107035703 | A | 8/2017 |
| CN | 206368786 | U | 8/2017 |
| CN | 107387384 | A | 11/2017 |
| CN | 107476998 | A | 12/2017 |
| CN | 107795517 | | 3/2018 |
| CN | 207145273 | U | 3/2018 |
| CN | 207145276 | U | 3/2018 |
| CN | 108131308 | A | 6/2018 |
| CN | 207526720 | | 6/2018 |
| CN | 108317097 | A | 7/2018 |
| CN | 207673622 | | 7/2018 |
| CN | 207795534 | U | 8/2018 |
| CN | 207795640 | U | 8/2018 |
| CN | 208010629 | U | 10/2018 |
| CN | 208185017 | | 12/2018 |
| CN | 208310992 | U | 1/2019 |
| CN | 109480533 | A | 3/2019 |
| CN | 209115349 | U | 7/2019 |
| CN | 209115350 | U | 7/2019 |
| CN | 209115351 | U | 7/2019 |
| CN | 110219795 | A | 9/2019 |
| CN | 110230587 | A | 9/2019 |
| CN | 110513312 | A | 11/2019 |
| CN | 209687693 | U | 11/2019 |
| CN | 209761774 | U | 12/2019 |
| CN | 210397186 | U | 4/2020 |
| CN | 210423098 | U | 4/2020 |
| CN | 1210531184 | U | 5/2020 |
| CN | 211116501 | | 7/2020 |
| CN | 111677681 | A | 9/2020 |
| CN | 111852827 | A | 10/2020 |
| CN | 212225472 | U | 12/2020 |
| CN | 112155371 | A | 1/2021 |
| CN | 212272509 | U | 1/2021 |
| CN | 212454758 | U | 2/2021 |
| CN | 115163460 | A | 10/2022 |
| CN | 217652945 | U | 10/2022 |
| CN | 217783698 | U | 11/2022 |
| CN | 218030724 | U | 12/2022 |
| CN | 218894778 | U | 4/2023 |
| CN | 218894779 | U | 4/2023 |
| CN | 219353454 | U | 7/2023 |
| DE | 1479712 | | 7/1969 |
| DE | 1909938 | A1 | 12/1969 |
| DE | 202012002366 | | 6/2012 |
| DE | 202014100140 | | 4/2014 |
| DE | 202014102362 | | 10/2014 |
| DE | 102014100330 | A1 | 7/2015 |
| EP | 0789976 | A1 | 8/1997 |
| EP | 1707821 | A1 | 10/2006 |
| EP | 1961335 | A1 | 8/2008 |
| EP | 2532281 | A1 | 12/2012 |
| EP | 2997858 | A1 | 3/2016 |
| EP | 3059451 | | 8/2016 |
| EP | 3072419 | A1 | 9/2016 |
| EP | 3228870 | A1 | 10/2017 |
| EP | 3362688 | A1 | 8/2018 |
| EP | 3653878 | A1 | 5/2020 |
| EP | 3674560 | A1 | 7/2020 |
| EP | 3708845 | A2 | 9/2020 |
| EP | 3717782 | A1 | 10/2020 |
| EP | 3968119 | A1 | 3/2022 |
| EP | 3994357 | A1 | 5/2022 |
| EP | 4083437 | A2 | 11/2022 |
| EP | 2582287 | B1 | 3/2023 |
| EP | 4278095 | A2 | 11/2023 |
| EP | 4372228 | A1 | 5/2024 |
| GB | 2428751 | | 2/2007 |
| JP | 04-067428 | | 3/1992 |
| JP | 05-084123 | | 4/1993 |
| JP | 07-054781 | | 2/1995 |
| JP | H1146934 | | 2/1999 |
| JP | 2000-197672 | | 7/2000 |
| JP | 3182060 | | 7/2001 |
| JP | 2013-127206 | | 6/2013 |
| JP | 5929157 | | 6/2016 |
| SU | 268313 | | 4/1970 |
| WO | 02/15835 | | 2/2002 |
| WO | 2008/037136 | | 4/2008 |
| WO | 2017/064553 | | 4/2017 |
| WO | 2019/102443 | A1 | 5/2019 |
| WO | 2019/148383 | A1 | 8/2019 |
| WO | 2021/174436 | A1 | 9/2021 |
| WO | 2023/230849 | A1 | 12/2023 |
| WO | 2024/100624 | A1 | 5/2024 |
| WO | 2024/100625 | A1 | 5/2024 |

OTHER PUBLICATIONS

Partial European Search Report for EP Patent Application No. 20836715.1, Issued on May 9, 2023, 10 pages.

International Preliminary Report on Patentability received for PCT Patent Application No. PCT/IB2016/001484, mailed on Apr. 26, 2018, 7 pages.

International Preliminary Report on Patentability received for PCT Patent Application No. PCT/IB2018/059009, mailed on May 28, 2020, 8 pgaes.

International Preliminary Report on Patentability received for PCT Patent Application No. PCT/IB2018/059367, mailed on Jun. 11, 2020, 7 pages.

International Search Report and Written Opinion received for PCT Patent Application No. PCT/IB2016/001484, mailed on Feb. 23, 2017, 8 pages.

International Search Report and Written Opinion received for PCT Patent Application No. PCT/IB2018/059009, mailed on Feb. 11, 2019, 10 pages.

International Search Report and Written Opinion received for PCT Patent Application No. PCT/IB2018/059367, mailed on Mar. 27, 2019, 10 pages.

International Search Report and Written Opinion received for PCT Patent Application No. PCT/IB2022/062750, mailed on Mar. 20, 2023, 14 pages.

Supplemental European Search Report in EP16855009 dated May 13, 2019, 9 pages.

Yingyi Motor, Micro Air Pump (2004), 4 pages, www.yingyimotor.com/product/60423125783-801366169/Micro_Air_Pump_YYP370_XB2_DC3V_6V_9V_12V_24V.html, Nov. 12, 2019.

"50PSI Electric Paddle Board Pump, Dual Motor SUP Air Pump for Inflation and Deflation, Multifunctional Auto-Off Sup Inflator Pump Electric for Stand Up Paddle Boards, Cars, Air Mattress, etc." amazon.com, Jul. 3, 2024, pp. 1-8.

"67624—Bestway® 80" × 60" × 18"/2.03m × 1.52m x 46cm AlwayzAire Air Mattress Queen Built-in Dual Pump," m. bestwaycorp.com, May 14, 2024, pp. 1-3.

"Aria Twin Inflatable Air Mattress with ConstantComfort Built-in Pump, SelfInflating Air Bed Maintains Selected Firmness for Luxurious All-Night Sleep Comfort, Beige," amazon.com, May 14, 2024, pp. 1-8.

"Bestway 12" Tritech Queen Air Mattress with Built-in Pump" www.walmart.com, May 7, 2024, pp. 1-4.

"Bestway Smart Hub", Google Play Store, Mar. 6, 2024, pp. 1-4.

"CHILLSUN Twin Air Mattress Inflatable Airbed with Built in Pump, 3 Mins Quick Self-Inflation, Comfortable Top Surface Blow Up Bed for Home Portable Camping Travel, 75×39×18", 550 lb MAX" amazon.com, May 7, 2024, pp. 1-10.

"Electric Pumpdc" flated.com, Jan. 11, 2025, pp. 1-4.

(56) References Cited

OTHER PUBLICATIONS

"EZ Air Bed Self-Inflating Twin Size Air Mattress with Built-in Frame, Pump and Wheeled Case" www.simplicomfy.com, May 7, 2024, pp. 1-8.
"INTEX Dura-Beam Plus Essential Rest Air Mattress Fiber-Tech Queen Size Built-in Electric Pump, 18in Bed Height, 600lb Weight Capacity, Grey" www.amazon.com, May 7, 2024, pp. 1-10.
Protekt Aire 4000DX Alternating Pressure Low Air Loss Mattress System—36"× 80", newleafhomemedical.com, May 14, 2024, pp. 1-8.
"REM Air System Replacement Wired Air Bed Pump Compatible with Select Comfort or Sleep Number Mattresses," amazon.com, May 14, 2024, pp. 1-7.
"Sealy AlwayzAire Tough Guard Duvet Top Air Mattress Queen with Built-in Dual Pump" target. com, Jul. 24, 2024, pp. 1-9.
"Serta Raised Air Mattress with Never Flat Pump | Luxury Inflatable Mattress with Built in Air Pump to Ensure a Good Night's Rest | Heavy Duty Blow Up Mattress with Self Inflating Pump" www.amazon.com, Nov. 11, 2015, pp. 1-9.
"SoundAsleep CloudNine Series Air Mattress with Dual Smart Pump Technology" soundasleepproducts. com, Nov. 16, 2018, pp. 1-3.
"SoundAsleep Dream Series Luxury Air Mattress with ComfortCoil Technology & Built-in High Capacity Pump for Home & Camping—Double Height, Adjustable, Inflatable Blow Up, Portable—Queen Size" www.amazon.com, May 7, 2024, pp. 1-9.
"Stryker Service Manual", IsoAir, 2016, pp. 1-144.
"Tuomico Air Mattress Single, Twin Size Air Bed, Inflatable Air Mattress with Built-in Electric Pump, 3 Mins Fast Inflation Blow Up Bed for Family Use and Travelling Portable, 191*99*40CM Single" www.amazon.ae, May 7, 2024, pp. 1-5.
"Yawn Air Bed—Self-inflating Airbed King Size—Great Guest Bed, Camping Mattress—Built-in Pump & Headboard—Grey Fabric Material—Available in UK Single, Double and King" amazon. com, Aug. 6, 2019, pp. 1-9.
Zhang et al., "A Feasibility Study on Smart Mattresses to Improve Sleep Quality", Journal of Healthcare Engineering, vol. 2021, No. 6127894, 2021, pp. 1-12.
National Intellectual Property Administration, PRC, International Search Report and Written Opinion for International Application No. PCT/IB2020/056351, mailed Oct. 21, 2020.

* cited by examiner

DIVERSIFIED AND REMOVABLE PUMP SYSTEMS AND METHODS FOR INFLATING AND DEFLATING INFLATABLE OBJECTS

CROSS-REFERENCE TO RELATED APPLICATIONS

This application is a national stage application of International Application No. PCT/IB2020/056351, filed Jul. 6, 2020, which claims priority to Chinese Application Serial No. 201921041113.0, filed Jul. 5, 2019; Chinese Application Serial No. 201921040823.1, filed Jul. 5, 2019; Chinese Application Serial No. 201921041114.5, filed Jul. 5, 2019; Chinese Application Serial No. 202020213452.9, filed Feb. 26, 2020; Chinese Application Serial No. 202020352250.2, filed Mar. 19, 2020; and Chinese Application Serial No. 202020478355.2, filed Apr. 3, 2020, the disclosures of which are hereby expressly incorporated by reference herein in their entireties.

FIELD OF THE DISCLOSURE

The present disclosure relates to pump systems having multiple, diverse applications and uses relating to the inflation or deflation of inflatable products, such as air mattresses.

BACKGROUND

Inflatable products are common in households due to the convenience of storage or transportation when such products are in a deflated state coupled with the utility of such products when in an inflated state. For example, air mattresses are often used in households both inside and outside of the home for activities such as camping or providing overnight guests with a bed. Air mattresses are generally provided with at least one inflatable air chamber and may be inflated or deflated using an electric pump.

Most existing inflatable products are configured to match with a single air pump. As inflatable products and corresponding pumps continue to diversify in style and function while increasing in complexity, different inflatable products may use different types of air pumps in the future, leading to inconsistency in the air pumps used. Such inconsistency may result in affected appearance, cumbersome operation, inconvenient inflation, and negative experiences in the use of inflatable products.

SUMMARY

The present disclosure relates to pump systems having multiple, diverse applications and uses for use with inflatable products. Specifically, the present disclosure relates to pump systems where inflation or deflation of the associated inflatable product may be accomplished in more than one way while using a single pump. For example, inflation or deflation may be accomplished by utilizing electronic means or, alternatively, manual means.

In an exemplary embodiment, a system for use with an inflatable product is disclosed, the system comprising a pump assembly and a mounting assembly configured to selectively receive and couple to the pump assembly, the mounting assembly fixedly coupled to the inflatable product. The pump assembly further comprises: a pump housing forming a pump housing chamber, the pump housing defining a first vent in communication with the inflatable product; a control panel rotatably coupled to the pump housing, the control panel comprising a second vent in communication with the surrounding environment and the pump housing chamber; a pump body disposed in the pump housing chamber and coupled to the control panel; a pump cover disposed in the pump housing chamber, the pump cover coupled to the pump body, wherein the pump cover cooperates with the pump body to form an impeller chamber and comprises an air inlet and an air outlet in communication with the impeller chamber; an impeller disposed within the impeller chamber; a motor disposed within the pump housing and operable to operate the impeller, the impeller configured to direct air from the air inlet to the air outlet of the pump cover; and a disc disposed between the pump cover and the first vent of the pump housing, the disc comprising a third vent and a fourth vent, wherein at least one of: the third vent is in communication with the first vent of the pump housing and in selective communication with the air inlet and the air outlet of the pump cover, and the third vent is in communication with the air inlet of the pump cover and in selective communication with the first vent of the pump housing.

The mounting assembly may comprise a body defining a second chamber accessible by a second chamber opening, the second chamber comprising a fifth vent in communication with the inflatable product, and a check valve positioned within the fifth vent. The fifth vent may be configured to selectively receive a valve plug. The system may further comprise a cover coupled to the body and configured to selectively cover the second chamber opening. The second chamber may be sized and shaped to receive at least a portion of a power cord, the power cord operably coupled to the motor. The mounting assembly may comprise a fixing ring fixedly coupled to the inflatable product. The control panel, the pump body, the pump cover, and the disc may synchronically rotate to selectively place the pump assembly in an inflation configuration, a deflation configuration, or an off configuration.

In another exemplary embodiment, a system for use with an inflatable product is disclosed. The system comprises: a pump assembly comprising a pump housing forming a pump housing chamber, the pump housing defining a first vent; and a mounting assembly coupled to the inflatable product, the mounting assembly comprising a fixing ring fixedly coupled to the inflatable product and a body coupled to the fixing ring, the body defining a pump assembly coupling portion and a second chamber. The pump assembly coupling portion comprises a hollowed ring structure configured to detachably couple with the pump housing of the pump assembly. The body defines a second vent positioned at a bottom surface of the second chamber, wherein a check valve is disposed within the second vent.

The mounting assembly may further comprise a cover detachably coupled to an opening of the second chamber to provide selective access to the second chamber. An inner wall of the pump assembly coupling portion of the body of the mounting assembly may comprise a threaded spiral configured to cooperate with a threaded portion of an outer surface of the pump housing. An inner wall of the pump assembly coupling portion of the body of the mounting assembly may define at least one limit groove, the at least one limit groove configured to detachably couple to a tab disposed on an outer surface of the pump housing. The second chamber may be sized and shaped to selectively receive at least a portion of a power cord, the power cord operably coupled to the pump assembly.

The pump assembly may further comprise a control panel rotatably coupled to the pump housing, the control panel comprising a third vent in communication with the surrounding environment and the pump housing chamber; a pump body disposed in the pump housing chamber and coupled to the control panel; a pump cover dispose din the pump housing chamber, the pump cover coupled to the pump body, wherein the pump cover cooperates with the pump body to form an impeller chamber and comprises a first air inlet and a first air outlet in communication with the impeller chamber; an impeller disposed within the impeller chamber; a motor disposed within the pump housing and operable to operate the impeller, the impeller configured to direct air from the air inlet to the air outlet of the pump cover; and a selection disc disposed between the first vent of the pump housing and the pump cover, the selection disc comprising a second air inlet in communication with the first air inlet of the pump cover and a second air outlet in communication with the first air outlet of the pump cover, wherein the second air inlet and the second air outlet are in selective communication with the first vent of the pump housing. The pump body may comprise a flange, a switch pedestal fixedly coupled to the flange by a spring pin, and a switch coupled to the switch pedestal. The system may further comprise a knob disposed on the control panel, wherein the third vent is positioned within the knob.

In yet another exemplary embodiment, a system for use with an inflatable product is disclosed, the system comprising a pump assembly. The pump assembly further comprises: a pump housing forming a pump housing chamber, the pump housing defining a first vent and an opening opposite of the first vent, a window provided in a sidewall of the pump housing at an upper portion of the pump housing near the opening; a control panel rotatably arranged in the upper portion of the pump housing so that a portion of the control panel extends past the upper portion of the pump housing; and a switch disposed on a lower end of the control panel so that the switch is selectively accessible via the window of the pump housing when the pump assembly is in a first configuration.

The lower end of the control panel may be defined by a ring-shaped or semi-ring-shaped lower rim, a gap defined between the lower rim and the sidewall of the pump housing so that the lower rim is capable of rotation without contact between the switch and the sidewall of the pump housing. The system may further comprise a first operation mark disposed on the lower end of the control panel so that the first operation mark is selectively accessible via the window of the pump housing when the pump assembly is in a second configuration. The system may further comprise a second operation mark disposed on the lower end of the control panel so that the second operation mark is selectively accessible via the window of the pump housing when the pump assembly is in a third configuration.

The pump assembly may further comprise: a pump body disposed in the pump housing chamber and coupled to the control panel via at least one connection column, the pump body comprising a flange fixedly coupled to a pedestal, the pedestal defining a pin aperture and a pin mounted in the pin aperture; and a fixing ring fixed to an inner sidewall of the pump housing and disposed on the pump body so that the pump body is configured to rotate while the fixing ring remains stationary, the fixing ring comprising at least two position apertures configured to selectively receive the pin, wherein a first position aperture corresponds with a second configuration of the pump assembly and a second position aperture corresponds with a third configuration of the pump assembly. The pump assembly may further comprise: a pump cover disposed in the pump housing chamber, the pump cover coupled to the pump body, wherein the pump cover cooperates with the pump body to form an impeller chamber and comprises an air inlet and an air outlet in communication with the impeller chamber; an impeller disposed within the impeller chamber; a motor disposed within the pump housing and operable to operate the impeller, the impeller configured to direct air from the air inlet to the air outlet of the pump cover; and a disc disposed between the pump cover and the first vent of the pump housing, the disc comprising a third vent and a fourth vent, wherein at least one of: the third vent is in communication with the first vent of the pump housing and in selective communication with the air inlet and the air outlet of the pump cover; and the third vent is in communication with the air inlet of the pump cover and in selective communication with the first vent of the pump housing. The fixing ring may comprise a third position aperture corresponding with the first configuration of the pump assembly.

In yet another embodiment, a system for use with an inflatable product is disclosed, the system comprising a pump assembly. The pump assembly comprising: a pump housing forming a pump housing chamber, the pump housing defining a first vent and an opening, a control panel arranged within the opening of the pump housing, a pump body disposed within the pump housing chamber and coupled to the control panel, the pump body defining a first groove; a regulation mechanism comprising a baffle and a connection rod coupled to the baffle, the connection rod moveably coupled to the pump body so that the baffle is configured to partially or completely cover or uncover the groove.

The control panel may define a second groove, the second groove configured to moveably receive the connection rod of the regulation mechanism so that a portion of the connection rod extends upward beyond the control panel. The regulation mechanism may further comprise a toggle head coupled to the portion of the connection rod extending upward beyond the control panel. A diameter of the toggle head may be greater than a diameter of the connection rod. A diameter of the connection rod may be less than or equal to the width of the first groove. Each of the first groove and the baffle may be arc-shaped. The baffle may be larger in size than the first groove.

The pump assembly may further comprise: a pump cover disposed in the pump housing chamber, the pump cover coupled to the pump body, wherein the pump cover cooperates with the pump body to form an impeller chamber and comprises an air inlet and an air outlet in communication with the impeller chamber; an impeller disposed within the impeller chamber; a motor disposed within the pump housing and operable to operate the impeller, the impeller configured to direct air from the air inlet to the air outlet of the pump cover; and a disc disposed between the pump cover and the first vent of the pump housing, the disc comprising a third vent and a fourth vent, wherein at least one of: the third vent is in communication with the first vent of the pump housing and in selective communication with the air inlet and the air outlet of the pump cover; and the third vent is in communication with the air inlet of the pump cover and in selective communication with the first vent of the pump housing.

In another embodiment, a system for use with an inflatable product is disclosed, the system comprising a fixing ring comprising a fixing ring seat and a fixing ring body, the fixing ring body fixedly coupled to the inflatable product, and at least one engagement groove disposed on an upper surface of the fixing ring body; and a pump assembly comprising a pump housing forming a pump housing chamber, the pump housing defining a first vent and an opening, and at least one pump engagement tab extending outwardly from a sidewall of an upper portion of the pump housing, the pump engagement tab configured to selectively engage the at least one engagement groove of the fixing ring so that when assembled, a majority of the pump assembly passes through the fixing ring and extends into the inflatable body.

The pump housing may define a second groove on an outer wall of the pump housing, the second groove receiving a first seal. The system may further comprise a cover comprising at least one cover engagement tab extending outwardly from the cover, the cover engagement tab configured to selectively engage the at least one engagement groove of the fixing ring. The cover may comprise a knob, the knob defining a second vent, wherein a first one-way valve is disposed within the second vent. The cover may define a third groove on a perimeter of the cover, the third groove receiving a second seal. The fixing ring may define a third vent corresponding with the first vent of the pump housing when the fixing ring is coupled to the pump assembly. The third vent may contain a second one-way valve, so that the first vent of the pump housing is configured to open the second one-way valve of the third vent when the pump assembly is coupled to the fixing ring.

In yet another embodiment, a pump assembly for use with an inflatable product is disclosed, the pump assembly comprising: a pump housing forming a pump housing chamber, the pump housing defining a first vent comprising a first fixing ring; a one-way valve disposed within the first vent, the one-way valve comprising a valve plate movably coupled to the first fixing ring, a valve rod extending upward from the valve plate, and a flange disposed on the valve rod opposite of the valve plate, a spring disposed on the valve rod between the valve plate and the flange; a disc disposed within the pump housing chamber above the first vent of the pump housing, the disc comprising a second vent and a third vent, the second vent comprising a fixing ring and in communication with the first vent; and an ejector rod comprising a connecting rod coupled to the fixing ring and movably mounted within the first vent, the ejector rod further comprising at least two side arms and a head mounted to the connecting rod; wherein the ejector rod is configured to selectively cooperate with the one-way valve to open the one-way valve.

The pump assembly may further comprise a pump cover disposed in the pump housing chamber above the disc, the pump cover defining an inlet and an outlet, each of the inlet and the outlet in selective communication with the third vent of the disc, wherein the pump cover comprises an annular groove defined in a bottom surface of the pump cover, the annular groove configured to receive the head of the ejector rod so that the head travels within the annular groove, and wherein a stopper is positioned in the inlet of the pump cover so that when the inlet of the pump cover is aligned with the second vent of the disc, the stopper pushes the ejector rod downward to open the one-way valve. The pump assembly may further comprise a control panel rotatably coupled to the pump housing, the control panel comprising a fourth vent in communication with the surrounding environment and the pump housing chamber; a pump body disposed in the pump housing chamber and coupled to the control panel, the pump body coupled to the pump cover, wherein the pump cover cooperates with the pump body to form an impeller chamber; an impeller disposed within the impeller chamber; and a motor disposed within the pump housing and operable to operate the impeller, the impeller configured to direct air from the air inlet to the air outlet of the pump cover.

A system may include a valve seat fixedly coupled to the inflatable body, the valve seat may be configured to selectively and removably receive the pump assembly, the valve seat comprising a fifth vent corresponding with the first vent of the pump housing when the valve seat receives the pump assembly. A valve plug may be coupled to the valve seat, wherein the valve plug is configured to selectively be received by the fifth vent.

In another embodiment of the present disclosure, a pump assembly is disclosed, the pump assembly comprising: a pump housing defining a pump housing chamber, the pump housing comprising an upper casing and a lower casing, the lower casing defining a first vent; a rotary assembly rotatably mounted within the upper casing, an inner wall of the rotary assembly comprising at least two position stoppers, wherein a first position stopper corresponds with a first configuration of the pump assembly and a second position stopper corresponds with a second configuration of the pump assembly; a pump body disposed in the pump housing chamber and coupled to the control panel; a pump cover disposed in the pump housing chamber, the pump cover coupled to the pump body, wherein the pump cover cooperates with the pump body to form an impeller chamber and comprises an air inlet and an air outlet in communication with the impeller chamber, the pump cover further comprising a flange, wherein a switch is mounted to the flange to selectively cooperate with the first position stopper and the third position stopper of the rotary assembly; an impeller disposed within the impeller chamber; a motor disposed within the pump housing and operable to operate the impeller, the impeller configured to direct air from the air inlet to the air outlet of the pump cover; and a stationary disc disposed between the pump cover and the first vent of the lower casing, the disc comprising a second vent and a third vent, wherein the second vent is in communication with the first vent of the pump housing and in selective communication with the air inlet and the air outlet of the pump cover and the third vent is in selective communication with the other of the air inlet and the air outlet of the pump cover.

The upper casing may define a limiting window and the rotary assembly may further comprise a laterally protruding portion configured to be received within the limiting window of the upper casing, wherein a third stopper is disposed on the laterally protruding portion. The rotary assembly may include a knob defining a fourth vent, the fourth vent in communication with the surrounding environment and the pump housing chamber. The stationary disc may define a groove on a top surface of the stationary disc, and a boss corresponding with the groove is disposed on a bottom surface of the pump cover. A one-way valve may be movably mounted within the first vent and an ejector rod is movably disposed in a passage defined by the first vent and the second vent, so that the ejector rod is configured to selectively cooperate with the one-way valve to open the one-way valve.

BRIEF DESCRIPTION OF THE DRAWINGS

The above mentioned and other features of this present disclosure, and the manner of attaining them, will become more apparent and the invention itself will be better understood by reference to the following description of embodiments of the present disclosure taken in conjunction with the accompanying drawings, wherein.

Figure 1:
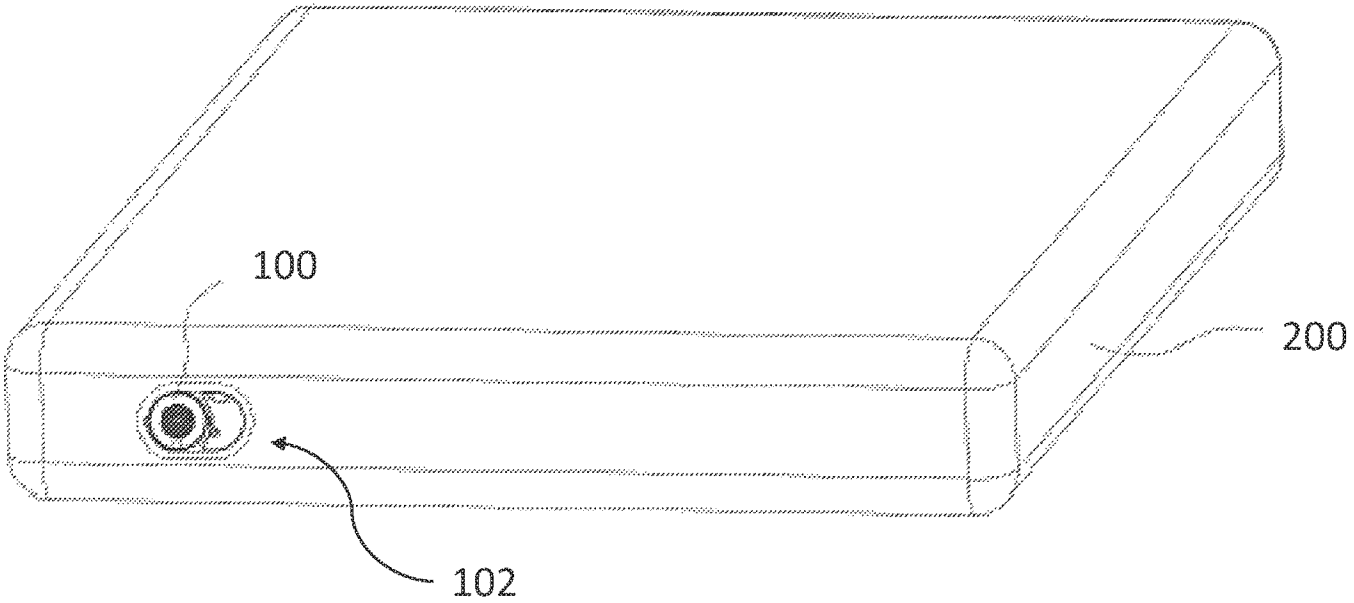
FIG. 1 illustrates an inflatable body, such as an air mattress, comprising an exemplary air pump inflation system, the air pump inflation system including a removable pump assembly.

Corresponding reference characters indicate corresponding parts throughout the several views. Although the exemplification set out herein illustrates embodiments of the present disclosure, in several forms, the embodiments disclosed below are not intended to be exhaustive or to be construed as limiting the scope of the invention to the precise forms disclosed.

DETAILED DESCRIPTION

For the purpose of promoting an understanding of the principles of the invention, reference will now be made to the embodiments illustrated in the drawings and specific language will be used to describe the same. For example, directional terms may be used with reference to the orientation of the described drawings, including "top", "bottom", "left", "right", "up", "down" and so on. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Referring initially to FIG. 1, an inflation assembly 102 is disclosed positioned in a side wall of an inflatable body 200. While the inflatable body 200 is illustratively an inflatable mattress, the inflatable body 200 may include a variety of other inflatable products, including an inflatable chair, an inflatable sofa, an inflatable pool toy, or other inflatable products. The inflation assembly 102 may be utilized to inflate or deflate the inflatable body 200 as described further herein.

Figure 2:
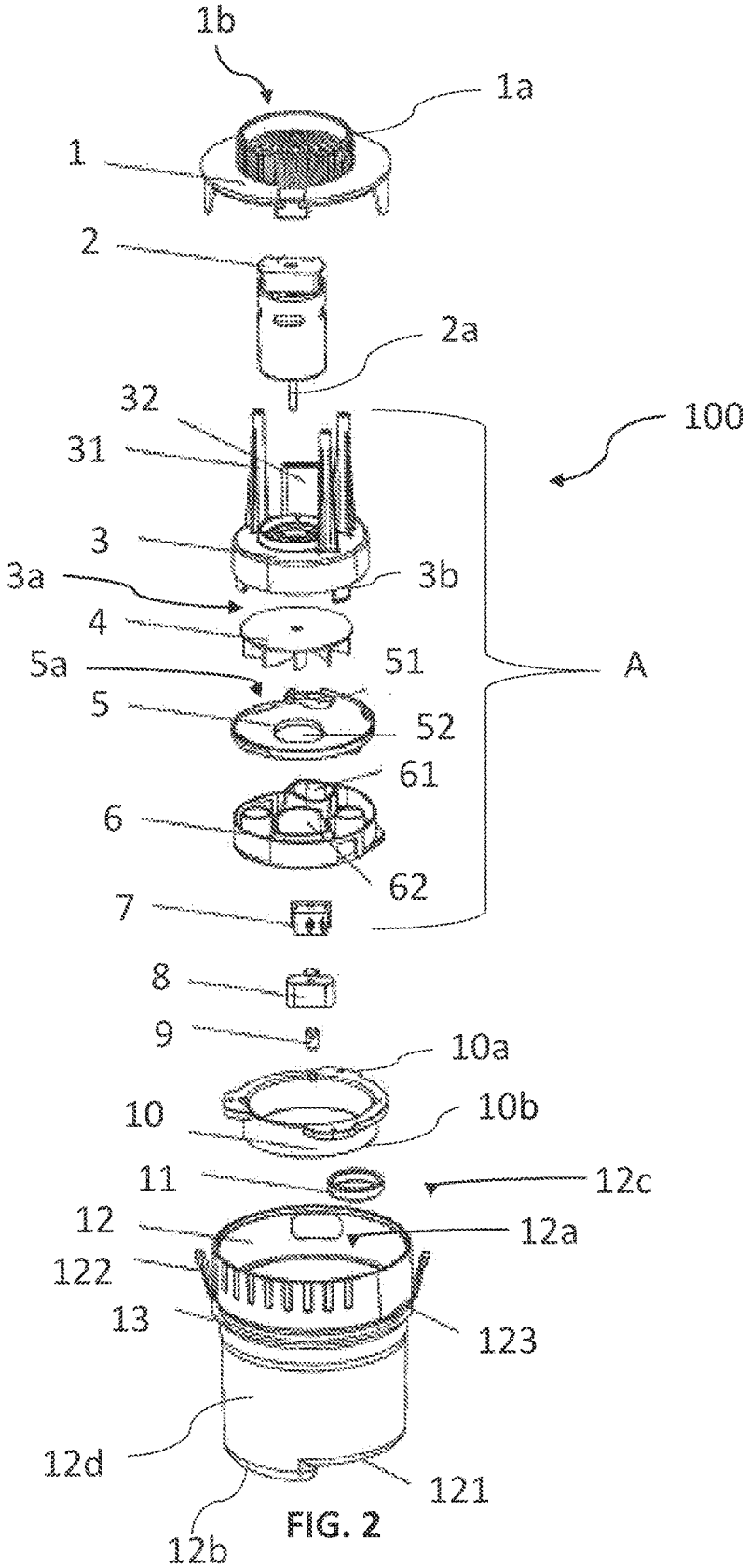
FIG. 2 is an exploded view of the pump assembly of the exemplary air pump inflation system of FIG. 1.

Now referring to FIG. 2, an exploded view of an illustrative pump assembly 100 of the inflation assembly 102 is shown. The pump assembly 100 includes a pump housing 12 defining a chamber 12*a* with a bottom surface 12*b* and an opening 12*c* opposite from the bottom surface 12*b*, the chamber 12*a* configured to house the components of the pump assembly 100 as described further herein. The pump housing 12 defines a vent 121 in the bottom surface 12*b* of the pump housing 12 to selectively allow airflow from the chamber 12*a* to the inflatable body 200 (FIG. 1) and/or selectively allow airflow from the inflatable body 200 (FIG. 1) to the chamber 12*a* as described further herein.

A rotation subassembly A is disposed within the chamber 12*a* of the pump housing 12, the rotation subassembly A including a selection disc 6, a pump cover 5, a pump body 3, and an impeller 4 as further described herein. A fixing ring 10 is coupled to an inner sidewall of the pump housing 12 via a plurality of flanges 10*a* and includes a sidewall 10*b* that is sized and shaped to receive at least a portion of the rotation subassembly A, while allowing the relevant components of the rotation subassembly A to rotate freely within the fixing ring 10 as needed. The fixing ring 10 provides support to the rotation subassembly A to prevent the components of the rotation subassembly A from swaying or otherwise unfavorably moving during use of the pump assembly 100 and affecting the effect of intake and exhaust.

The selection disc 6 includes an air outlet 61 and an air inlet 62; each of the air outlet 61 and the air inlet 62 may be placed in selective communication with the vent 121 defined by the pump housing 12. Illustratively, a seal 11 (e.g., an O-ring) is positioned between the selection disc 6 and the vent 121 to prevent air leakage from any existing gap between the selection disc 6 and the vent 121 during inflation or deflation, which may affect the rate of inflation or gas or fluid retention after inflation. While only one seal 11 is illustrated in FIG. 2, a greater number of seals may be utilized to increase the sealing effect. The pump cover 5 is positioned over the selection disc 6 and defines an air outlet 51 and an air inlet 52. The pump cover 5 and the selection disc 6 are coupled to provide synchronous rotation of the pump cover 5 and the selection disc 6, and so that the air outlet 51 of the pump cover 5 is in communication with the air outlet 61 of the selection disc 6 and the air inlet 52 of the pump cover 5 is in communication with the air inlet 62 of the selection disc 6. The pump body 3 cooperates with the pump cover 5 to define an impeller chamber 3*a* configured to receive the impeller 4. As illustrated, the pump body 3 includes a plurality of tabs 3*b*, each tab configured to cooperate with a corresponding aperture 5*a* of the pump cover 5. As such, rotation of the pump body 3 ideally results in synchronous rotation of the pump cover 5 and the selection disc 6.

The upper surface of the pump body 3 includes at least one connection column 31, wherein the connection column 31 is coupled to a control panel 1, which is configured to cover the opening 12*c* of the pump housing 12 when assembled. In an exemplary embodiment, the connection column 31 and the control panel 1 are fixedly coupled using a bolt. In other embodiments, other coupling mechanisms may be used, including the use of other mechanical fasteners, adhesive, overmolding, snap-fit connection, or other methods as known to one of skill in the art. As shown in FIG. 1, the pump body 3 may include a plurality of connection columns 31, e.g., three. In some embodiments, the pump body 3 may include a single connection column, two connection columns, four connection columns, or more connection columns. Illustratively, the connection columns are evenly distributed around the pump body 3 to ensure synchronized rotation and steady connection of the control panel 1 with the pump body 3. Arrangement of the connection columns 31 may vary depending on the size and shape of the pump assembly 100.

Still referring to FIG. 2, a knob 1*a* is disposed on the control panel 1, the knob 1*a* including a knob vent 1*b* to place the chamber 12*a* in communication with ambient air outside of the pump assembly 100. The knob vent 1*b* additionally prevents the need of an additional vent in the upper surface of the control panel 1, which ensures both a pleasing appearance and forms an airflow channel. In other embodiments, other forms of the knob 1*a* may be present to allow communication between the chamber 12*a* and ambient air. Actuation of the knob 1*a*, including rotation, results in corresponding movement of the control panel 1. Due to the connection between the control panel 1 and the pump body 3 via the connection columns 31, actuation of the knob 1*a* further results in corresponding movement of the pump body 3, the pump cover 5, and the selection disc 6 allowing switching of the pump assembly operation between an inflation operation, a deflation operation, and an off configuration as further described herein.

A motor 2 is disposed on the upper surface of the pump body 3, preferably fixedly coupled to the pump body 3 in a position substantially central to the connection columns 31. The motor 2 includes a rotational motor shaft 2*a*. In the illustrated embodiment, the rotational motor shaft 2*a* rotates in the same direction during both an inflation operation and a deflation operation. It is also within the scope of the present disclosure for the rotational motor shaft 2*a* to rotate in a first direction corresponding with an inflation operation and a second direction corresponding with a deflation operation. The rotational motor shaft 2*a* is disposed through the pump body 3 to couple to the impeller 4 within the impeller chamber 3*a* so that the motor 2 may drive the impeller 4 to rotate to perform an inflation operation or a deflation operation as further described herein. The pump body 3 may further comprise a flange 32. A switch pedestal 8 fixedly engages with the flange 32 via a spring pin 9, the switch pedestal 8 coupled with a switch 7. A switch hole (not shown) may be provided in the sidewall 12*d* of the pump housing 12 so that the switch 7 is arranged exterior of the pump housing 12 through the switch hole. Ideally, the switch 7 is positioned near the opening 12*c* of the body to easily facilitate manual operation by a user. The switch 7 may comprise a rocker switch, which provides convenience to the user to control operation of the pump assembly 100. The switch 7 may also comprise other types of switches, e.g., a microswitch, to effectively facilitate operation of the pump assembly 100. It is also within the scope of the present disclosure for the switch 7 to be triggered based on rotation of knob 1*a* without requiring further user input.

Figure 3:
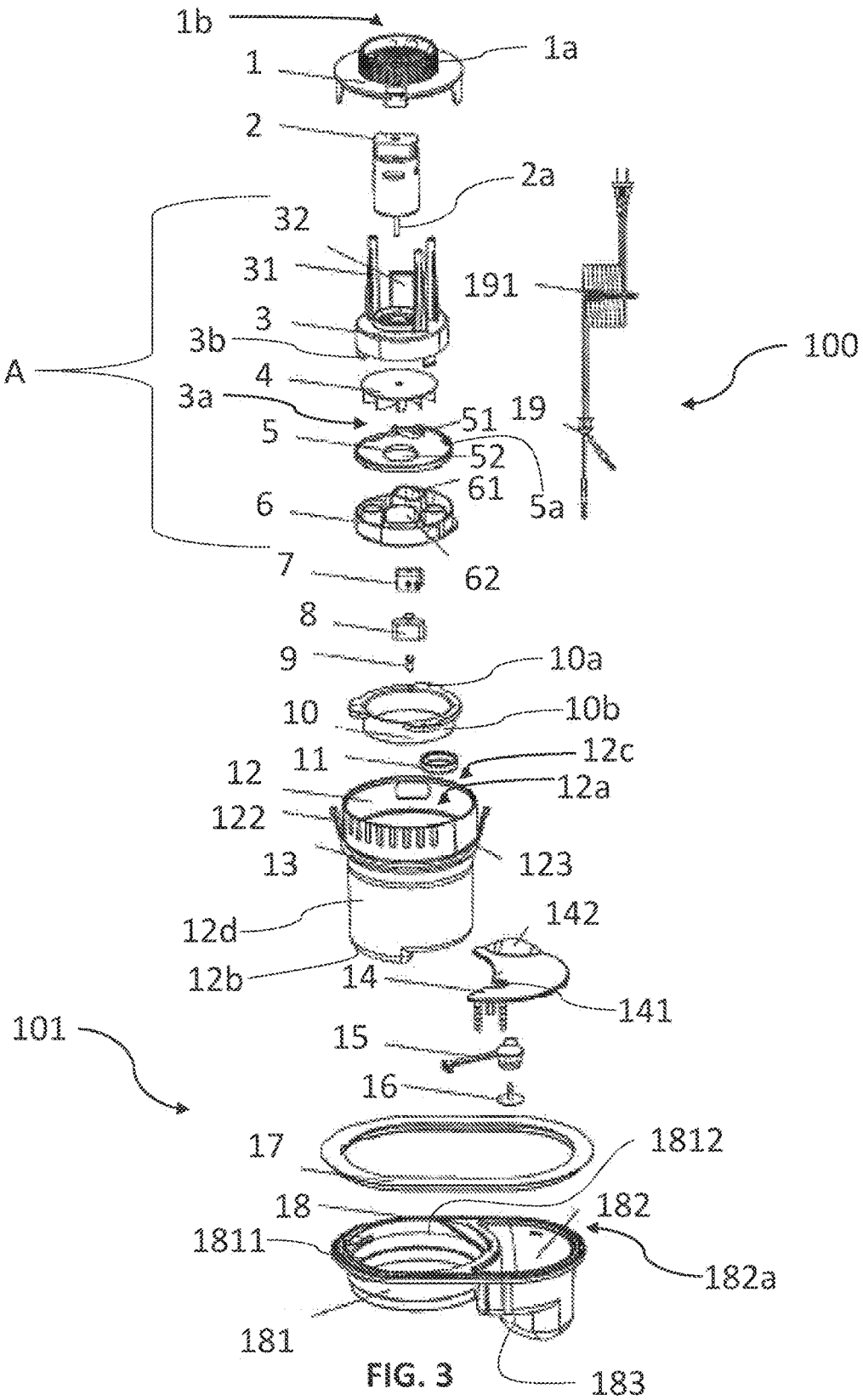
FIG. 3 is an exploded view of the exemplary air pump inflation system of FIG. 1.

Referring now to FIG. 3, an exploded view of the inflation assembly 102, including pump assembly 100, is illustrated. As shown, in addition to pump assembly 100, the inflation assembly 102 further includes a mounting system 101. Also referring to FIG. 4, an illustration of the assembled pump assembly 100 and the separately assembled mounting system 101 is given. The mounting system 101 includes a system body 18 and a fixing ring 17 in tight connection with the system body 18, wherein the fixing ring 17 couples the system body 18 and the pump assembly 100 contained therein to the inflatable body 200 (FIG. 1). The system body 18 includes a pump assembly coupling portion 181, illustratively a hollowed ring structure having a fixing groove 1811. The pump assembly coupling portion 181 is sized and shaped to receive the pump assembly 100, so that the pump housing 12 is configured to mate with the fixing groove 1811 as described further herein, tightly fitting the pump housing 12 with the system body 18.

The fixing groove 1811 of the pump assembly coupling portion 181 is illustratively a threaded spiral configured to cooperate with threading 123 provided on an outer surface of the pump housing 12 to rotatably engage the pump housing 12. The pump assembly coupling portion 181 also includes one or more limit grooves 1812 configured to receive corresponding elastic tabs 122 positioned on the exterior of the pump housing 12. When in use, the elastic tabs 122 and the limit grooves 1812 fix the pump housing 12 in place relative to the system body 18, so as to allow rotation of the rotation subassembly A relative to the pump housing 12 of the pump assembly 100, without allowing the pump housing 12 to rotate relative to system body 18. Such a connection prevents the pump assembly 100 from disengaging from the system body 18 when in use and negatively affecting the operation of the pump assembly 100. When not in use, the user may manipulate the elastic tabs 122 to selectively release the pump housing 12 from the system body 18 as described further herein.

A seal 13 is illustratively disposed around the exterior sidewall 12*d* of the pump housing 12 and is configured to ensure the sealing of the pump assembly 100 and the mounting system 101. Preferably, the seal 13 has a T-shaped cross-section (see FIG. 4), with an inner wall closely adhered to an outer sidewall 12*d* of the pump housing 12, and a sealing protrusion extending in the opposite direction. With this seal structure, it is unnecessary to provide a groove in the pump housing 12 or in the interior wall of the pump assembly coupling portion 181, which simplifies the structure. While only one seal 13 is illustrated, multiple seals may be used to enhance the sealing effect. A similar effect may also be achieved using grooves in the inner sidewall of the pump assembly coupling portion 181 or the outer sidewall 12*d* of the pump housing 12 and corresponding conventional O-shaped seals.

Figure 4:
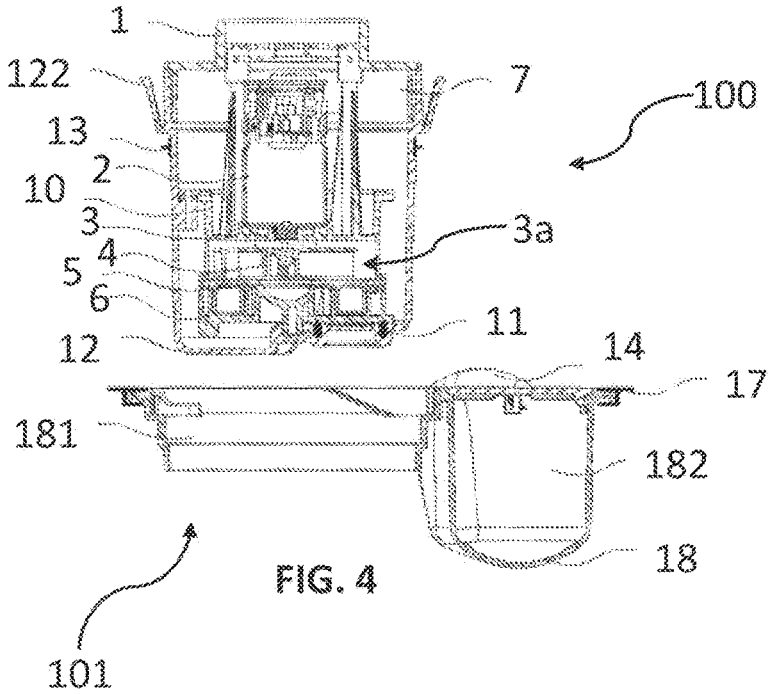
FIG. 4 is a cross-sectional, partially exploded view of the exemplary air pump inflation system of FIG. 1, the system shown in a detached configuration.

Still referring to FIGS. 3 and 4, the system body 18 further defines a second chamber 182 to one side of the pump assembly coupling portion 181, the second chamber 182 including a vent 183 with a check valve 16 and a valve plug 15 arranged inside the vent 183. A power cord 19 may be provided and in operative communication with the switch 7 of the pump assembly 100 for providing power to at least the switch 7 of the pump assembly 100. In certain embodiments, the power cord 19 is also configured to provide power to at least the motor 2 of the pump assembly 100. For example, the power cord 19 may be operably coupled to a wiring jack, the wiring jack having wires operably coupled to both of the switch 7 and the motor 2. Such a split setting may provide a more concise structure to the inflation assembly 102. The power cord 19 may also be provided with an adjustable belt 191 for binding the power cord 19 in a stored configuration. The power cord 19 and a corresponding plug 19*a* may be stored in the second chamber 182 when not in use to avoid a scattered arrangement of the power cord 19 and thus prevent breakage of the power cord 19 and promoting a clean appearance.

A cover 14 may also be provided to detachably cover an opening 182*a* of the second chamber 182. Illustratively, the cover 14 forms a snap-fit coupling with the system body 18 to cover the opening 182*a* of the second chamber 182 and is provided with a handle 142 on an upper surface of the cover 14 to enable opening of the cover 14 and provide access to the second chamber 182. The cover 14 may further comprise a hole 141 configured to allow passage of the power cord 19 when in use. In other words, the second chamber 182 may house only a portion of the power cord 19, so that only a needed length of the power cord 19 passes through the hole 141 to facilitate operation of the pump assembly 100. The inflatable body 200 (FIG. 1) coupled to the inflation assembly 102 may be inflated with the pump assembly 100 provided within the system body 18. Alternatively, the inflatable body 200 may be inflated via the vent 183, which may serve as a spare inflation port for inflating the inflatable body 200 via a manual pumping device, for example when inflation assembly 102 malfunctions or an external power supply is not available.

Figure 5:
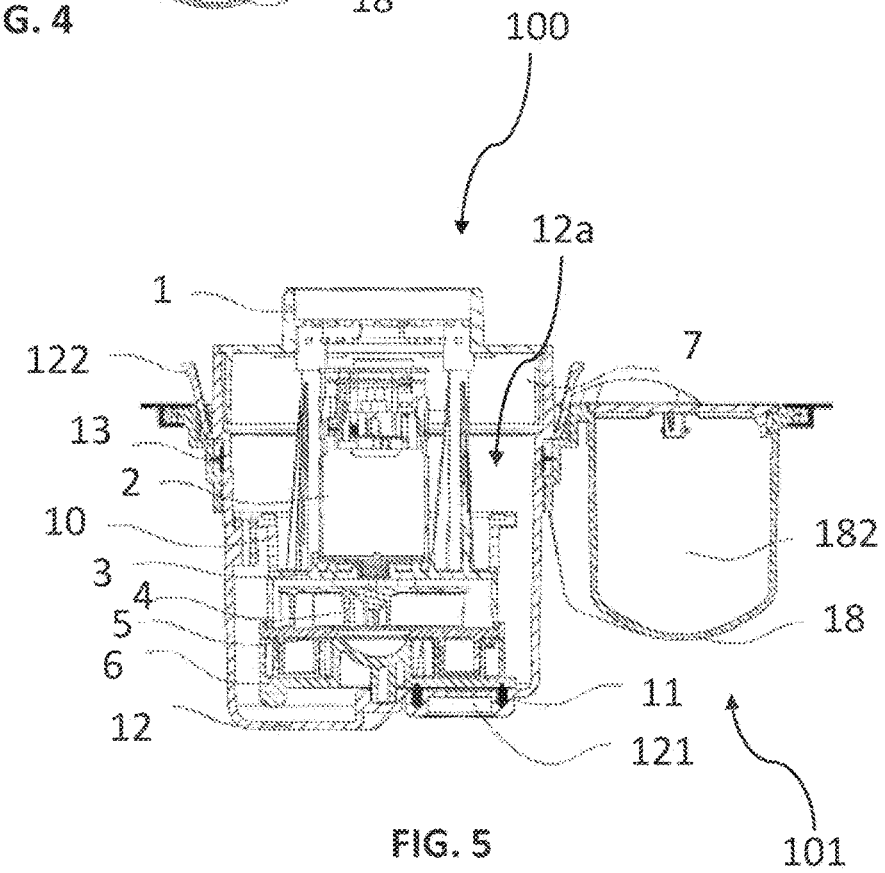
FIG. 5 is a cross-sectional view of the exemplary air pump inflation system of FIG. 1, the system shown in an off configuration.

Now referring to FIG. 5, a cross-section of the inflation assembly 102 in an off configuration is provided. As shown, the control panel 1 is rotated to an off position, so that the vent 121 is blocked by the selection disc 6 and neither the air outlet 61 (FIG. 2) nor the air inlet 62 (FIG. 2) of the selection disc 6 is in contact with the vent 121. In such a configuration, air cannot flow between the chamber 12*a* of the pump assembly 100 and the inflatable body 200 (FIG. 1).

Figure 6:
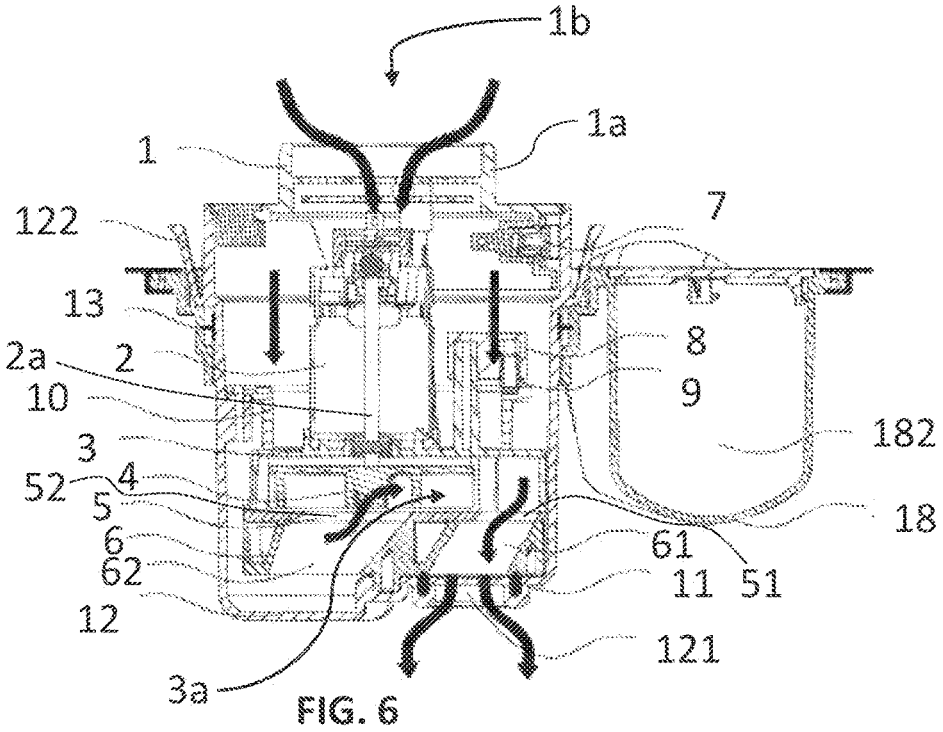
FIG. 6 is a cross-sectional view of the exemplary air pump inflation system of FIG. 1, the system shown in an inflation configuration

Referring to FIG. 6, a cross-section of the inflation assembly 102 in an inflation configuration is provided. As shown, the control panel 1 is rotated to an inflation position, so that the air outlet 51 of the pump cover 5 and the air outlet 61 of the selection disc 6 are in communication with the vent 121. A user may place the pump assembly 100 into operation via the switch 7, which operates the motor 2, causing the impeller 4 to rotate via the rotational motor shaft 2*a*. With rotation of the impeller 4, ambient air is drawn into the chamber 12*a* via the knob vent 1*b*. The air is then drawn into the impeller chamber 3*a* through the inlet 62 of the selection disc 6 and the inlet 52 of the pump cover 5, respectively. The air exits the impeller chamber 3*a* through the outlet 51 of the pump cover 5 and the outlet 61 of the selection disc 6, wherein the air is pumped into the inflatable body 200 (FIG. 1) via the vent 121.

Figure 7:
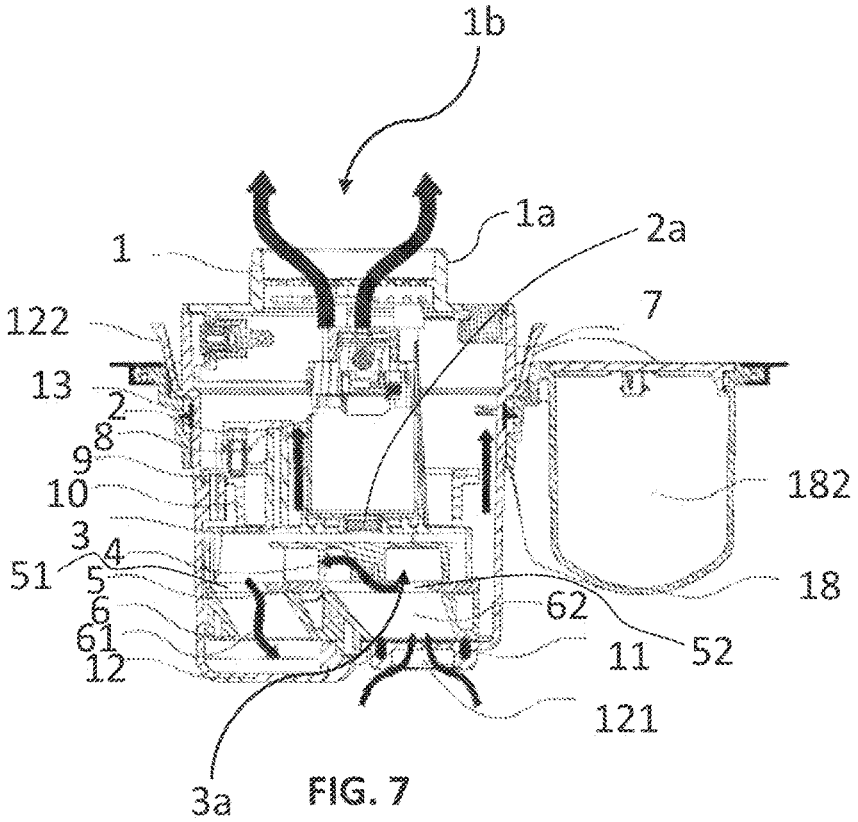
FIG. 7 is a cross-sectional view of the exemplary air pump inflation system of FIG. 1, the system shown in a deflation configuration.

Now referring to FIG. 7, a cross-section of the inflation assembly 102 in a deflation configuration is provided. As shown, the control panel 1 is rotated to a deflation position, so that the air inlet 52 of the pump cover 5 and the air inlet 62 of the selection disc 6 are in communication with the vent 121. A user may place the pump assembly 100 into operation via the switch 7, which operates the motor 2, causing the impeller 4 to rotate via the rotational motor shaft 2*a*. With rotation of the impeller 4, air from the inflatable body 200 (FIG. 1) is drawn into the impeller chamber 3*a* via the vent 121, the air inlet 62 of the selection disc 6, and the air inlet 52 of the pump cover 5. The air then exits the impeller chamber 3*a* and enters the chamber 12*a* via the air outlet 51 of the pump cover 5 and the air outlet 61 of the selection disc 6. The air is then pumped from the chamber 12*a* and into the surrounding atmosphere via the knob vent 1*b*.

Figure 8:
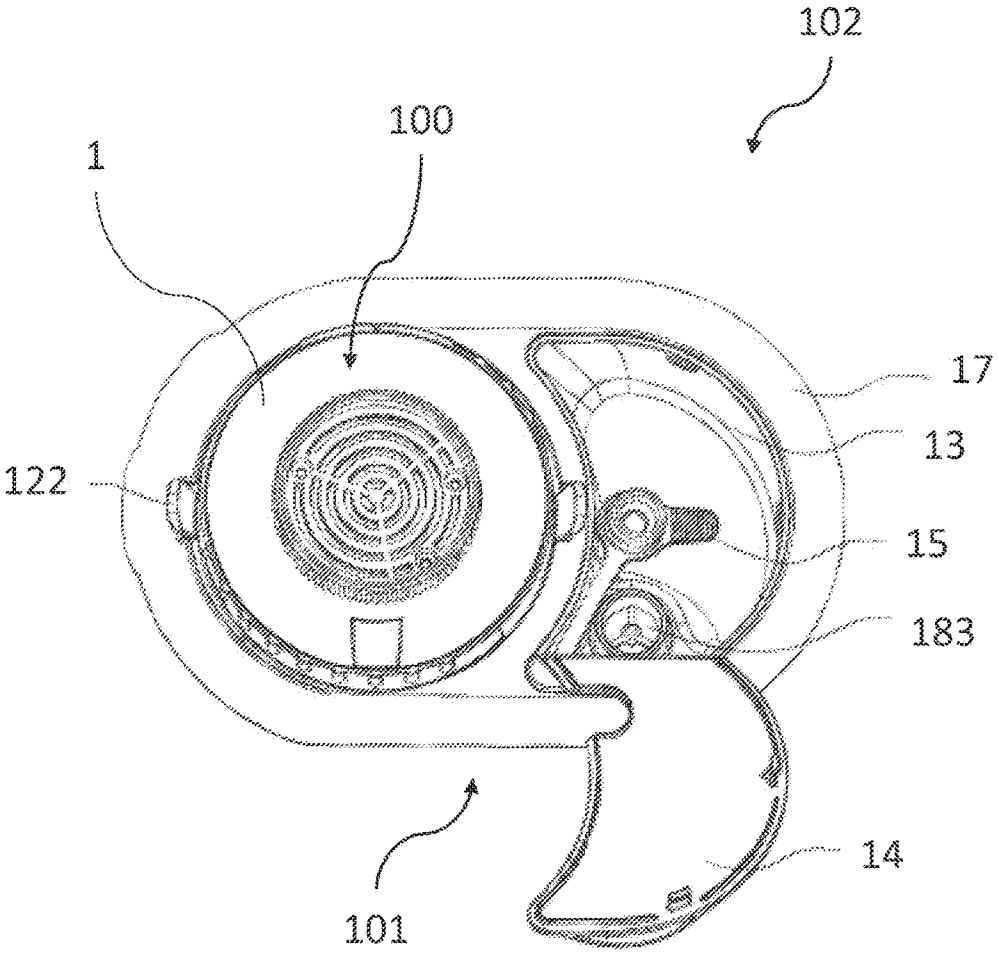
FIG. 8 is a top view of the exemplary air pump inflation system of FIG. 1, wherein a cover of the system is open to view the manual inflation port.

Generally, in each of the above-described configurations, the valve plug 15 (FIG. 3) remains positioned within the vent 183 of the second chamber 182 so as to prevent unwanted airflow between the inflatable body 200 and the second chamber 182. However, as shown in FIG. 8, the mounting system 101 also provides for the ability to use a manual inflation pump to inflate the attached inflatable body 200 (FIG. 1) as mentioned above. During such operation, the control panel 1 is rotated to the off position as described above in relation to FIG. 5. The cover 14 is opened to provide access to the second chamber 182 and the vent 183 positioned therein. The valve plug 15 is removed from the vent 183, and then a portion of the manual inflation device (not shown) is inserted into the vent 183 to force the check valve 16 open, allowing the manual inflation device to pump air beyond the check valve 16 through the vent 183 and into the inflatable body 200 (FIG. 1). Once the inflatable body 200 (FIG. 1) has reached the desired level of inflation, the manual inflation device is removed from the vent 183, allowing the check valve 16 to return to its original, closed position within the vent 183. The valve plug 15 is then fastened again so that the vent 183 is sealed by both the check valve 16 and the valve plug 15, which prevents leakage of the air inside the inflatable body 200 (FIG. 1).

Returning to FIG. 4, the inflation assembly 102 further includes a detached configuration in which the pump assembly 100 is detached from the mounting assembly 101. As noted above, this detached configuration may be achieved by freeing the elastic tabs 122 from the limit grooves 1812 and then unthreading the pump housing 12 from the system body 18. Once detached, the pump assembly 100 may be stored, used, repaired, and/or replaced independently of the inflatable body 200. For example, the pump assembly 100 may be used to inflate other inflatable products.

In summary, the inflation assembly 102 provides multiple operation modes. Application of these advantages to a diversity of inflatable products prolongs the service life of said objects. The inflation assembly 102 further provides a simple structure that is easy to install, operate, and/or detach.

Figure 9:
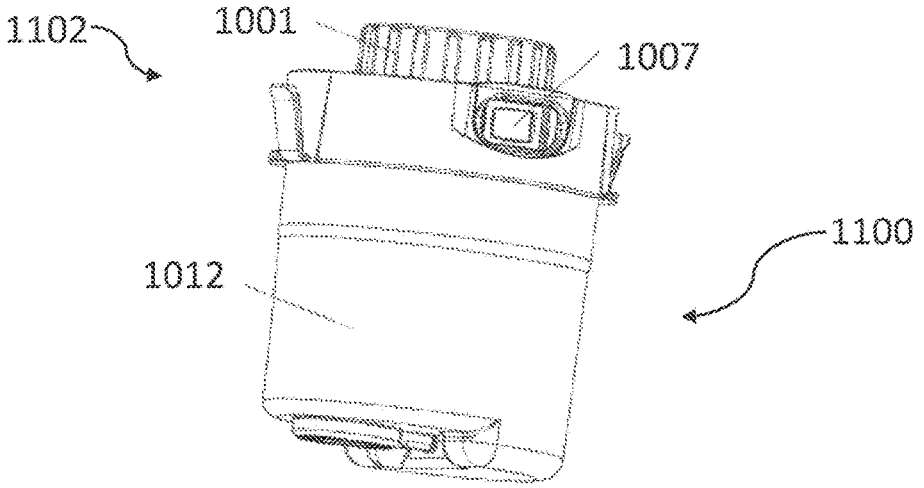
FIG. 9 is a perspective view of another exemplary air pump assembly, the air pump assembly including a viewing window to provide access to a switch for the air pump assembly and to view the configuration of the air pump assembly.

Beginning with FIG. 9, in another embodiment, components of an inflation assembly 1102 are disclosed. The inflation assembly 1102 is substantially the same as the inflation assembly 102 except as further described herein, wherein like components are like-numbered with the addition of "1000" added to the original reference number.

Figure 10:
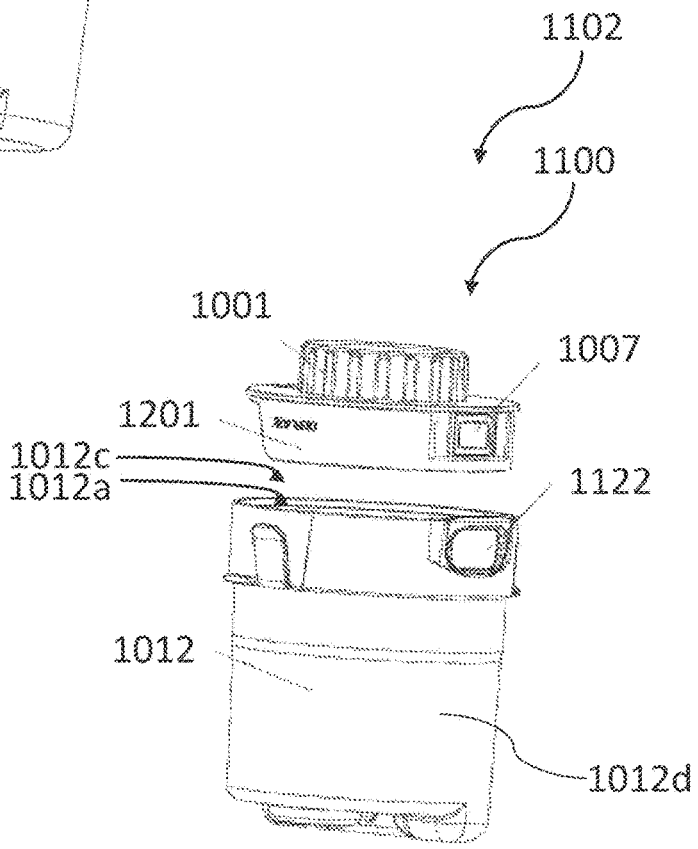
FIG. 10 is a partially exploded view of the exemplary air pump assembly of FIG. 9.

As shown in FIGS. 9-10, the inflation assembly 1102 includes a control panel 1001, a switch 1007, and a pump housing 1012. The switch 1007 and the control panel 1001 are rotatably arranged at an upper end of a chamber 1012*a* defined by the pump housing 1012, near an opening 1012*c* of the pump housing 1012. The switch 1007 is positioned on a lower rim 1201 of the control panel 1001, the lower rim 1201 illustratively being ring-shaped or semi-ring-shaped. The lower rim 1201 includes a deflation operation mark "DEFLATE" and an inflation operation mark "INFLATE", wherein each operation mark is configured to indicate the operation configuration of the inflation assembly 1102. Each operation mark may be concave or convex structures to provide a user with an indication that the status of the inflation assembly 1102 should be checked. Each operation mark may take other setting forms.

Each of the operation marks are ideally symmetrically arranged on the lower rim 1201 relative to the switch 1007. A viewing window 1222 may be defined within a sidewall 1012*d* of the pump housing 1012 at a position in which the operation marks and/or the switch 1007 is selectively visible through the viewing window 1222. For example, the switch 1007 may be viewed and manipulated through the viewing window 1222 when the inflation assembly 1102 is in an off configuration. When the control panel 1001 rotates, the switch 1007 is correspondingly rotated beyond the viewing window 1222 and eventually concealed by the sidewall 1012*d* of the pump housing 1012. When the switch 1007 is again needed, i.e., to halt operation of the inflation assembly 1012, the control panel 1001 must be rotated so that the switch 1007 is again viewable and accessible through the viewing window 1222. Such arrangement of the switch 1007 and selective accessibility through the viewing window 1222 results in an operation logic of the inflation assembly 1102 that avoids air leakage of the inflation assembly 1102 that may result from erroneous operation logic.

As illustrated in FIG. 10, the diameter of the lower rim 1201 is less than the diameter of the opening 1012*c* of the pump housing 1012. Additionally, the maximum distance between the switch 1007 and opposite sidewall of the lower rim 1201 across the center of the lower rim 1201 is less than the diameter of the opening 1012*c* of the pump housing 1012. Such measurements prevent the switch 1007 from touching the inner wall of the pump housing 1012 during rotation of the control panel 1001, thereby avoiding unwanted interference or change of the operational state of the switch 1007.

Figure 11:
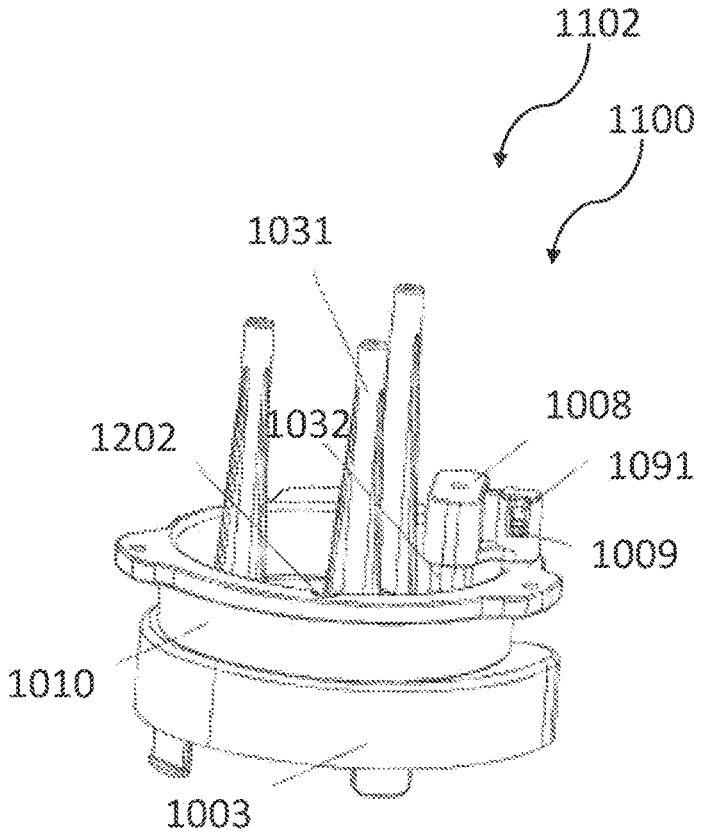
FIG. 11 is a perspective view of a pump body and coupling mechanism of the exemplary air pump assembly of FIG. 9.

Now referring to FIG. 11, the upper surface of the pump body 1003 includes a flange 1032 configured to engage with a groove of a pedestal 1008 to fixedly engage the pedestal 1008 with the pump body 1003. The pedestal 1008 includes a pin aperture 1081 in which a spring pin 1009 is mounted. A fixing ring 1010 positioned around connection columns 1031 of the pump body 1003 defines three position apertures 1202 to selectively receive the spring pin 1009 as the pump body 1003 rotates with the control panel 1001. Each of the position apertures 1202 corresponds with one of the operation configurations of the inflation assembly 1102 and the appropriate operation mark. The number of position apertures 1202 present on the fixing ring 1010 may vary with the needs of the inflation assembly 1002. The mating of the spring pin 1009 with the appropriate position aperture 1202 ensures the appropriate operation mark is displayed and/or the switch 1007 (FIGS. 9-10) is appropriately concealed or visible according to the operation configuration of the inflation assembly 1102. Additionally, the sound of the spring pin 1009 mating with the position aperture 1202 provides affirmation to the user that the positioning state is accurate.

Figure 12A:
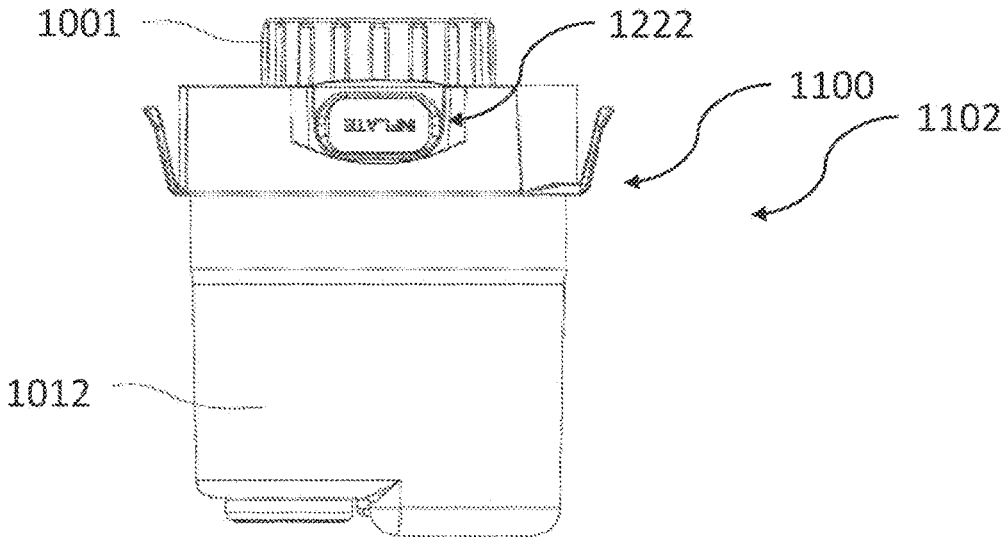
FIG. 12A is a plan view of the exemplary air pump assembly of FIG. 9, the assembly shown in an inflation configuration.
Figure 12B:
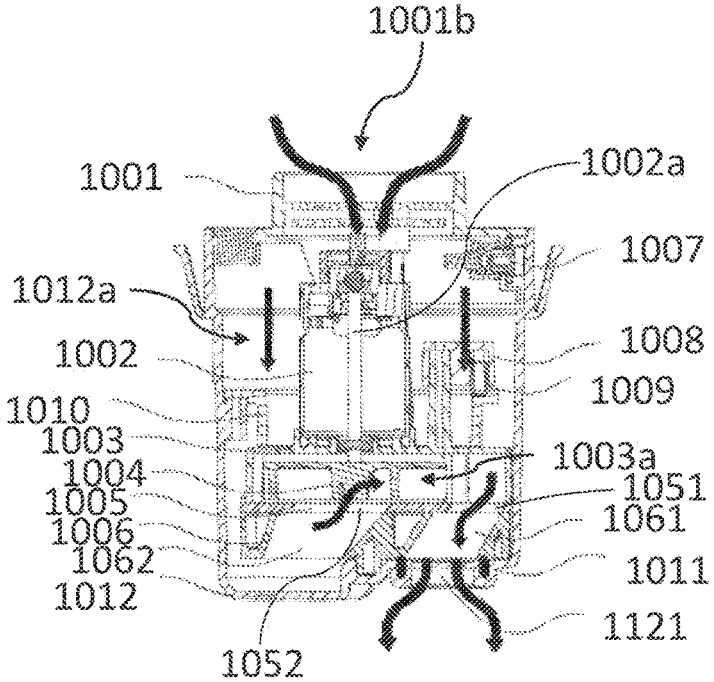
FIG. 12B is a cross-sectional view of the exemplary air pump assembly of FIG. 12A.

FIGS. 12A and 12B illustrate the inflation assembly 1102 in an inflation configuration. A user may place the inflation assembly 1102 into operation by toggling the switch 1007. The control panel 1001 is rotated to an inflation position, so that the operation mark "INFLATE" is visible through the viewing window 1222 and the switch 1007 is concealed from view.

Additionally, the air outlet 1061 of the selection disc 1006 is in communication with the vent hole 1121 of the pump housing 1012. With the toggling of the switch 1007, the motor 1002 begins to operate, causing the impeller 1004 to rotate via the rotational motor shaft 1002*a*. With rotation of the impeller 1004, ambient air is drawn into the chamber 1012*a* via the knob vent 1001*b*. The air is then drawn into the impeller chamber 1003*a* through the inlet 1062 of the selection disc 1006 and the inlet 1052 of the pump cover 1005, respectively. The air exits the impeller chamber 1003*a* through the outlet 1051 of the pump cover 1005 and the outlet 1061 of the selection disc 1006, wherein the air is pumped into the inflatable body 200 (FIG. 1) via the vent 1121.

Figure 13A:
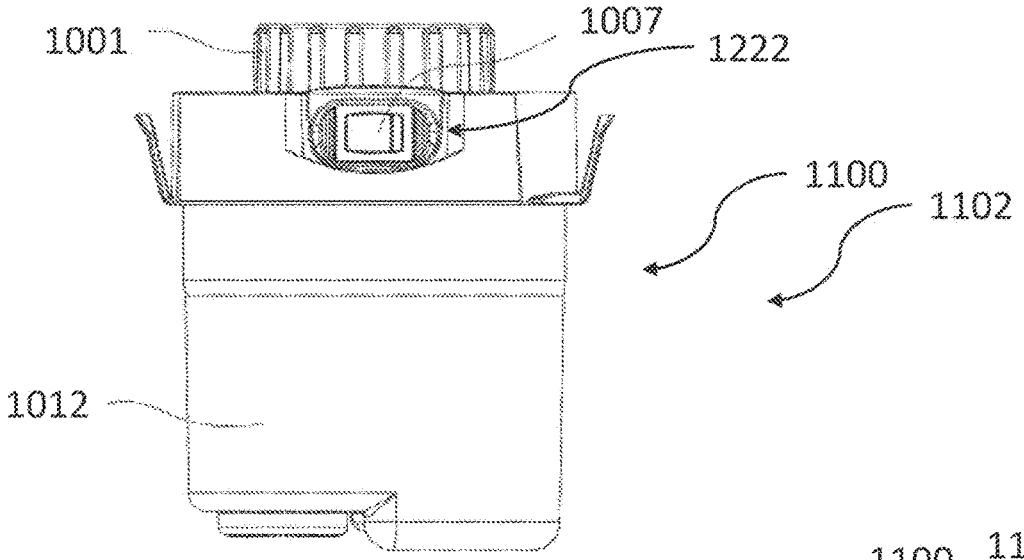
FIG. 13A is a plan view of the exemplary air pump assembly of FIG. 9, the assembly shown in an off configuration.
Figure 13B:
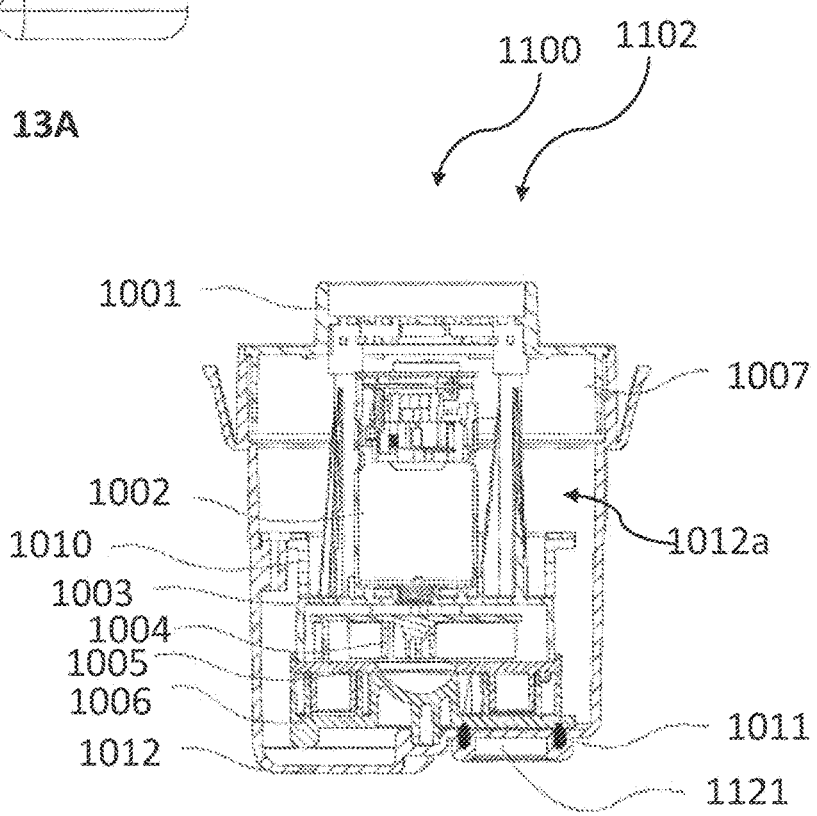
FIG. 13B is a cross-sectional view of the exemplary air pump assembly of FIG. 13A.

FIGS. 13A and 13B illustrate the inflation assembly 1102 in an off configuration. As shown, the control panel 1001 is rotated to an off position, so that the switch 1007 is visible and accessible through the viewing window 1222, and the switch 1007 is manually toggled so that it reflects the off state. The motor 1002 is non-operational. In such a configuration, neither the air outlet 1061 nor the air inlet 1062 of the selection disc 1006 is in contact with the vent 1121, and air cannot flow between the chamber 1012*a* of the pump assembly 1100 and the inflatable body 200 (FIG. 1).

Figure 14A:
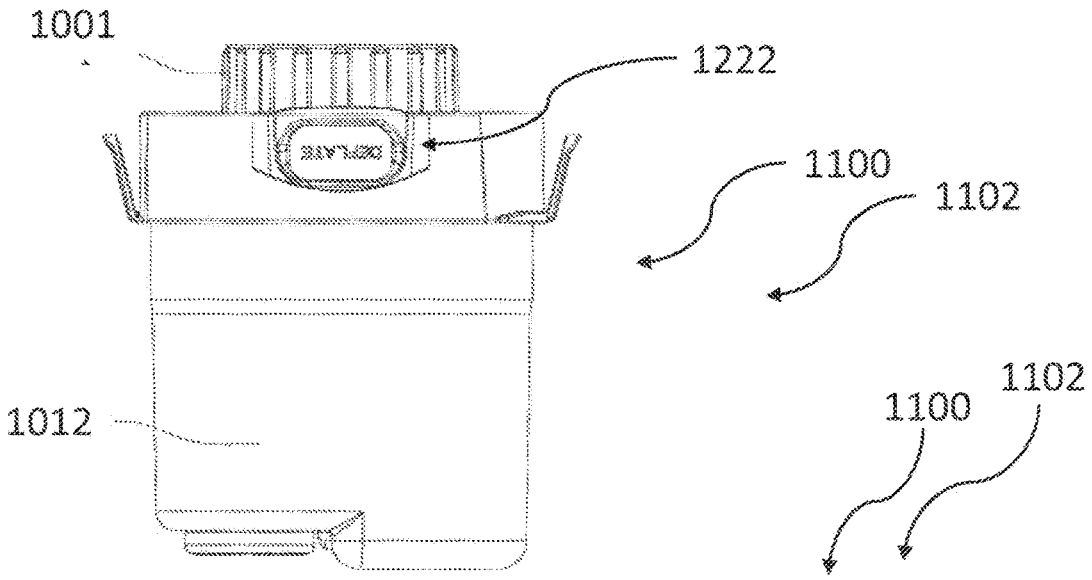
FIG. 14A is a plan view of the exemplary air pump assembly of FIG. 9, the assembly shown in a deflation configuration.
Figure 14B:
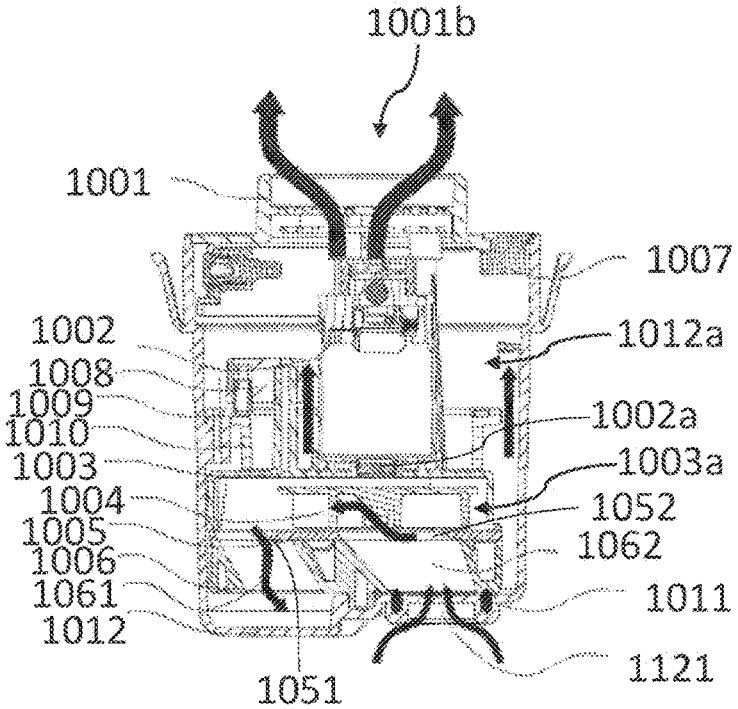
FIG. 14B is a cross-sectional view of the exemplary air pump assembly of FIG. 14A.

FIGS. 14A and 14B illustrate the inflation assembly 1102 in a deflation configuration. A user may place the inflation assembly 1102 into operation by toggling the switch 1007. The control panel 1001 is rotated to a deflation position, so that the operation mark "DEFLATE" is visible through the viewing window 1222 and the switch is concealed from view. Additionally, the air inlet 1052 of the pump cover 1005 and the air inlet 1062 of the selection disc 1006 are in communication with the vent 1121. With the toggling of the switch 1007, the motor 1002 begins to operate, causing the impeller 1004 to rotate via the rotational motor shaft 1002*a*. With rotation of the impeller 1004, air from the inflatable body 200 (FIG. 1) is drawn into the impeller chamber 1003*a* via the vent 1121, the air inlet 1062 of the selection disc 1006, and the air inlet 1052 of the pump cover 1005. The air then exits the impeller chamber 1003*a* and enters the chamber 1012*a* via the air outlet 1051 of the pump cover 1005 and the air outlet 1061 of the selection disc 1006. The air is then pumped from the chamber 1012*a* and into the surrounding atmosphere via the knob vent 1001*b*.

The inflation assembly 1102 separates the switch 1007 from the operation of switching operation configurations, requiring each to be operated independently of each other. In other words, the switch 1007 must be manually toggled, with the operation state of the inflation assembly 1102 then selected by rotation of the control panel 1001. The switch 1007 is concealed within the pump housing 1012 during the inflation or deflation operations, requiring the user to close the airway, i.e. place the inflation assembly 1102 in an off configuration, before the switch 1007 can be toggled off. This arrangement requires the user to close the airway first and avoid leakage of airflow caused by turning off the switch 1007 first. Such an arrangement additionally improves user experience by providing clear and easy-to-find information regarding the current airway configuration of the inflation assembly 1102, resulting in less damage to the inflation assembly 1102, and improving the service life of the inflation assembly 1102.

Figure 15:
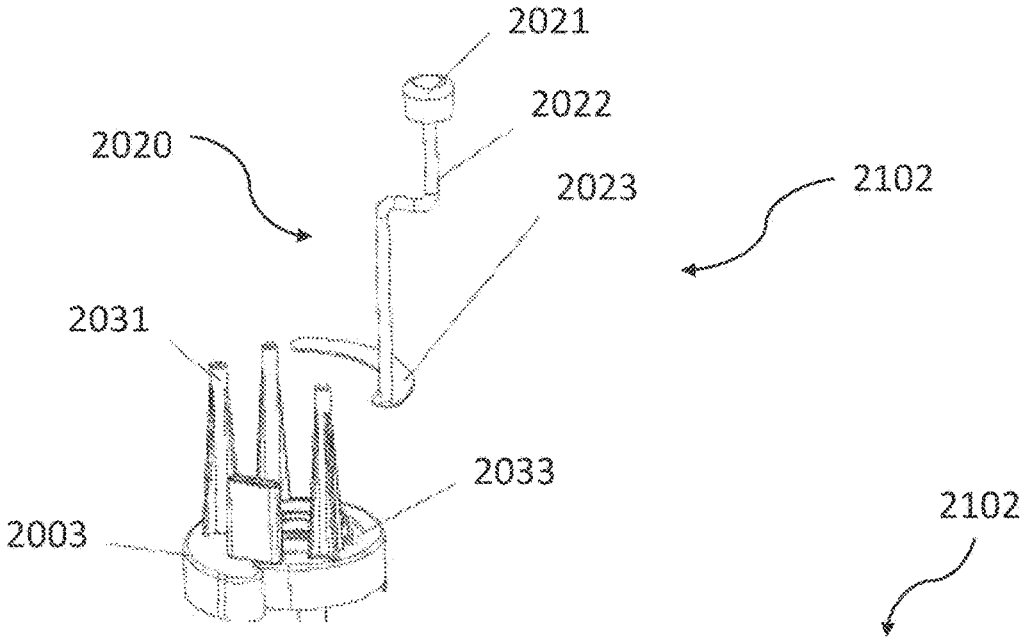
FIG. 15 is a partially exploded view of a pump body and an air pressure regulator of yet another exemplary air pump assembly.

Beginning with FIG. 15, in another embodiment, components of an inflation assembly 2102 are disclosed. The inflation assembly 2102 is substantially the same as the inflation assemblies 102 and 1102 except as further described herein, wherein like components are like-numbered with the addition of "2000" added to the original reference number.

Figure 16:
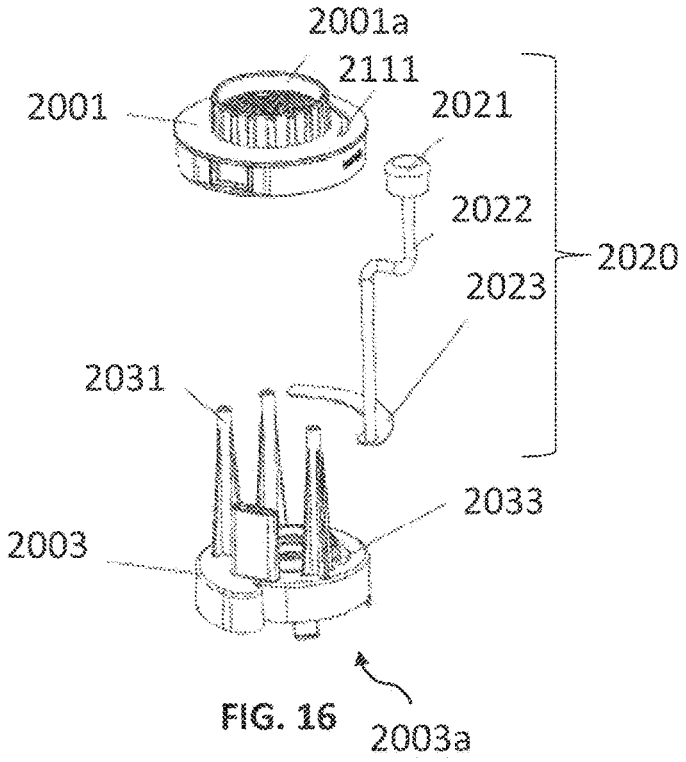
FIG. 16 is a partially exploded view of the pump body and the air pressure regulator of the air pump assembly of FIG. 15 in addition to a control panel.

As shown in FIGS. 15-16, the pump assembly 2100 of the inflation assembly 2102 includes a regulation mechanism 2020 comprising a toggle 2021, a connecting rod 2022, and a baffle 2023. The pump body 2003 includes a groove 2033 within the upper surface of the pump body 2003, wherein the groove 2033 and the baffle 2023 have complementary shapes, illustratively concentric arc shapes. These complimentary shapes allow the user to control the exposed surface area of the groove 2033 to provide the user greater regulation of air pressure. However, in other embodiments, a strip structure, a round structure, or a fan-shaped structure may be utilized, for example. Illustratively, the baffle 2023 is slightly larger in size than the groove 2033 to ensure complete coverage of the groove 2033.

In other embodiments, the groove 2033 may be positioned on alternate locations of the pump body 2003, for example, on a lateral side or bottom surface of the pump body 2003. In such embodiments with an alternately positioned groove 2033, the engagement of regulation mechanism 2020 varies accordingly so as to allow the inflation assembly 2102 to operate as described further herein.

Referring specifically to FIG. 16, a control panel 2001 of the inflation assembly 2102 is illustrated. The control panel 2001 includes a control groove 2111 shaped to complement the baffle 2023 and the pump body groove 2033. A knob 2001*a* is additionally positioned on an upper surface of the control panel 2001. When assembled, the baffle 2023 is positioned within the impeller chamber 2003*a* at the inner top surface of the impeller chamber 2003*a* so that the connecting rod 2022 passes upward through the pump body groove 2033 and the control groove 2111 to protrude from the upper surface of the control panel 2001. The connecting rod 2022 is slightly smaller in diameter than the width of each of the pump body groove 2033 and the control groove 2111 to facilitate installation of the connecting rod 2022 within the inflation assembly 2102 and additionally prevent swaying of the connecting rod 2022 within the pump body groove 2033 and the control groove 2111.

Figure 17:
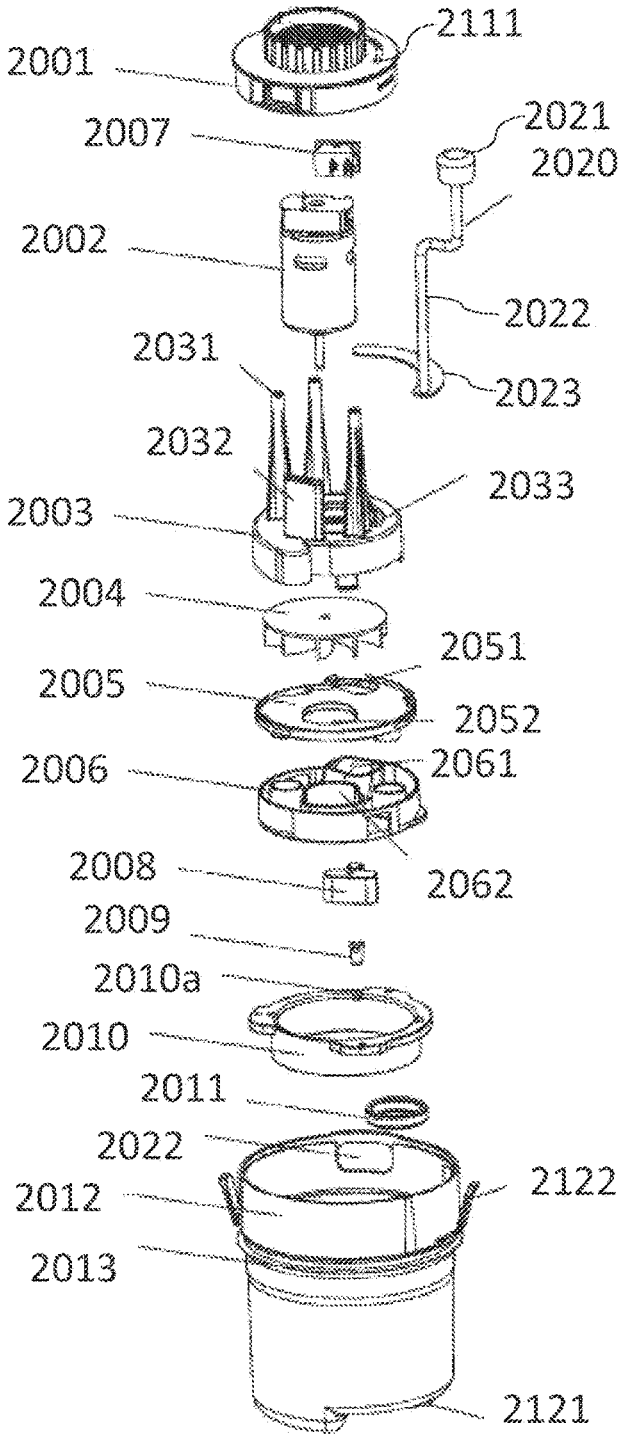
FIG. 17 is an exploded view of the exemplary air pump assembly of FIG. 15.

Referring additionally to FIG. 17, the toggle head 2021 is removably attached to the portion of the connecting rod 2022 protruding from the control panel 2001. The toggle head 2021 is greater in diameter than the width of the control groove 2111 and the pump body groove 2033 to help maintain the position of the connecting rod 2022 through the control groove 2111 and the pump body groove 2033. The toggle head 2021 facilitates movement of the baffle 2023 as described further herein, and may also be used to pull the connecting rod 2022 toward the control panel 2001 so as to ensure positioning of the baffle 2023 above the impeller 2004, preventing the baffle 2023 from touching the impeller 2004 or interfering with the rotation of the impeller 2004 during operation.

In other embodiments, the connecting rod 2022 may alternately protrude from the inflation assembly 2102 in other locations other than the control panel 2001 to provide effective coupling and control of the baffle 2023. For example, the control groove 2111 may be defined within a sidewall of the pump housing 2012. The connecting rod 2022 may be actuated by toggling or rotating the connecting rod 2022 to move the baffle 2023 relative to the pump body groove 2033 as discussed further herein.

As discussed above in relation to the inflation assembly 102 (FIGS. 1-8), the control panel 2001 of the inflation assembly 2102 is fixedly coupled with the pump body 2003 via a plurality of connection columns 2031 so that the pump body 2003 rotates in synchronization with the control panel 2001. Additionally, in the illustrated embodiment, the regulation mechanism 2020 is configured to rotate in synchronization with the control panel 2001 and the pump body 2003 to avoid unintended movement of the regulation mechanism 2020 relative to the control panel 2001 and interference of the connecting rod 2022 with the control groove 2111, ensuring stability of the regulation mechanism 2020 during rotation of the control panel 2001.

Figure 18A:
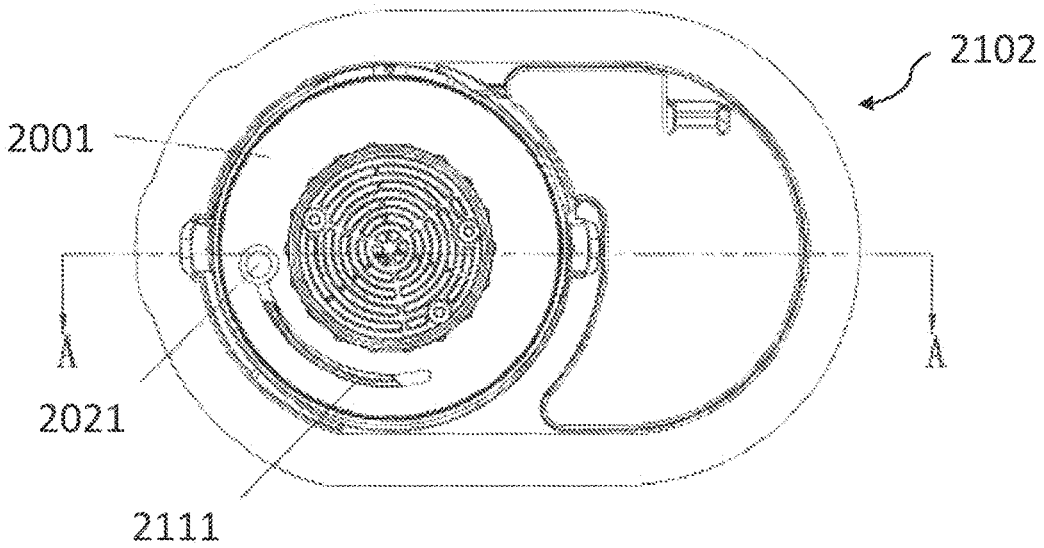
FIG. 18A is a top view of an inflation system including the exemplary air pump assembly of FIG. 15, the inflation system shown in a maximum air pressure configuration.
Figure 18B:
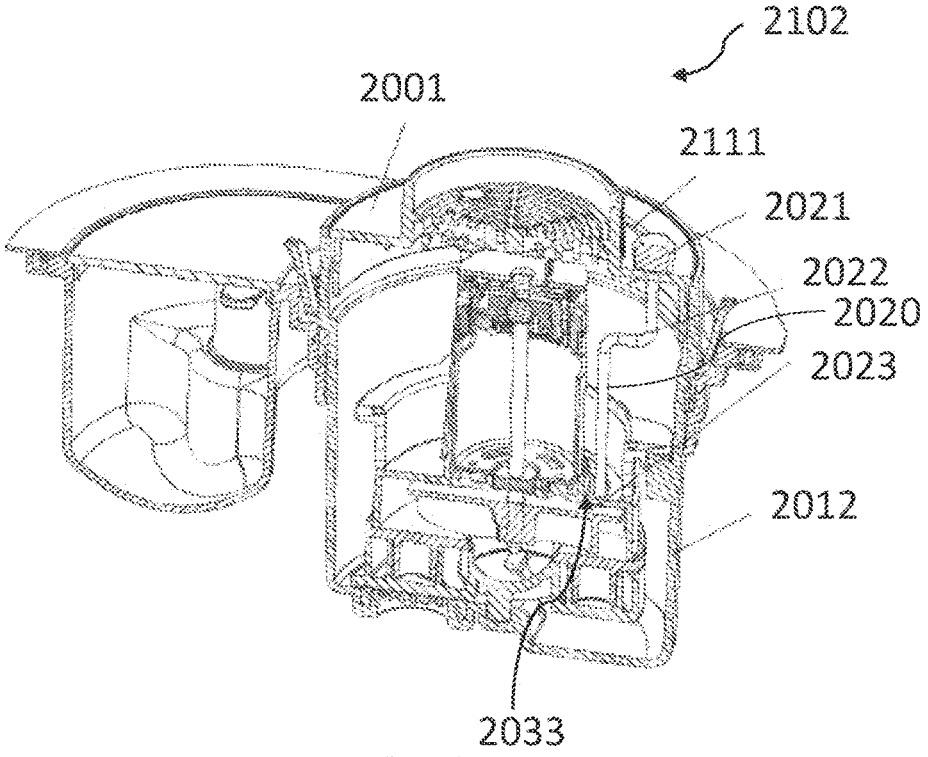
FIG. 18B is a cross-sectional view of the inflation system of FIG. 18A, taken along line A-A of FIG. 18A.

Now referring to FIGS. 18A and 18B, a maximum air pressure configuration of the inflation assembly 2102 is illustrated. As shown, the toggle head 2021 of the regulation mechanism 2020 is located at a first end of the control groove 2111 corresponding with the maximum air pressure configuration. Referring specifically to FIG. 18B, the baffle 2023 of the regulation mechanism 2020 shields the pump body groove 2033 so that a minimum area of the opening of the groove 2033 is exposed, or, ideally, none of the opening of the groove 2033 is exposed. As such, air cannot leak through the groove 2033, providing the maximum available air pressure to the inflatable body 200 (FIG. 1) during operation of the inflation assembly 2102.

Figure 19A:
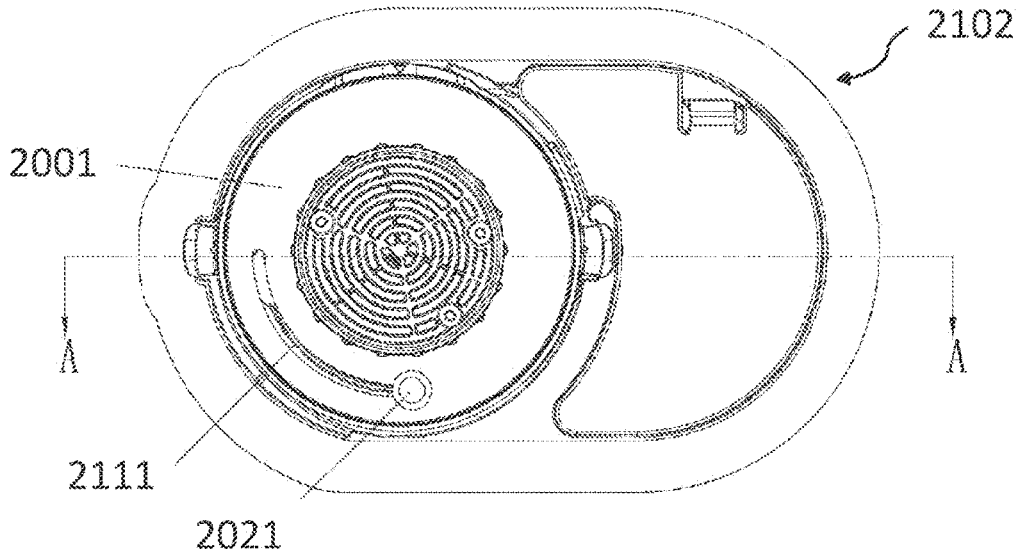
FIG. 19A is top view of an inflation system including the exemplary air pump assembly of FIG. 15, the inflation system shown in a minimum air pressure configuration.
Figure 19B:
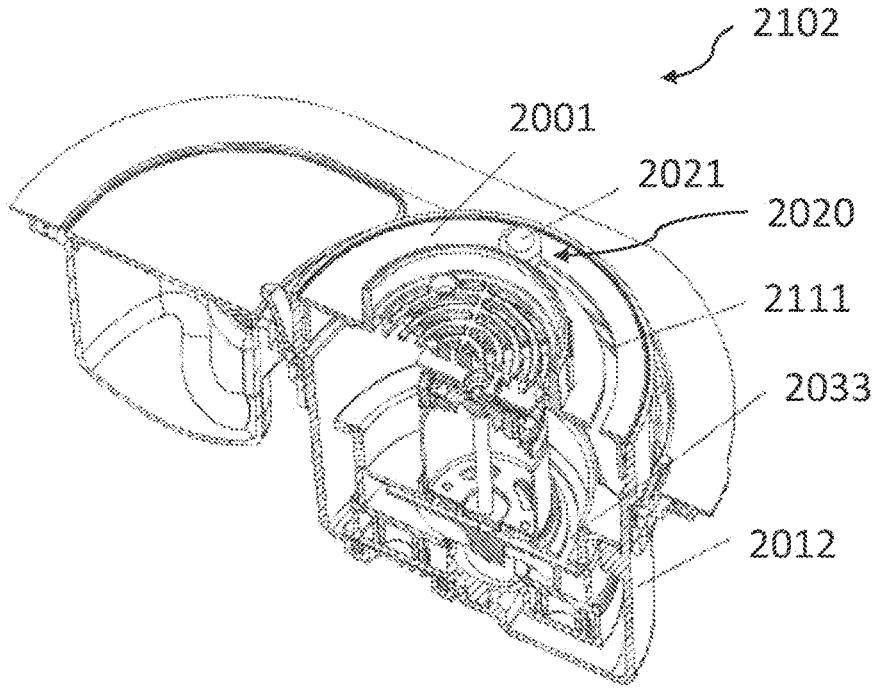
FIG. 19B is a cross-sectional view of the inflation system of FIG. 19A, taken along line A-A of FIG. 19A.

FIGS. 19A and 19B illustrate a minimum air pressure configuration of the inflation assembly 2102. As shown, the toggle head 2021 of the regulation mechanism 2020 is located at a second end of the control groove 2111 corresponding with the minimum air pressure configuration. Referring specifically to FIG. 19B, the baffle 2023 of the regulation mechanism 2020 (not visible in FIG. 19B) exposes the pump body groove 2033 so that a maximum area of the opening of the groove 2033 is exposed, or, ideally, the entire opening of the groove 2033 is exposed. As such, air within the impeller chamber 2003*a* will leak from the groove 2033 during operation of the inflation assembly 2102 so that the inflation assembly 2102 cannot reach the maximum air pressure of the inflation assembly 2102.

The configurations illustrated in FIGS. 18A-19B are not intended to be limiting of the configurations possible. The regulation mechanism 2020 is able to be positioned along the control groove 2111 at any position between the maximum air pressure configuration illustrated in FIGS. 18A-18B and the minimum air pressure configuration illustrated in FIGS. 19A-19B, as desired by the user. By selectively shielding the groove 2033 with a baffle 2023 under control of the regulation mechanism 2020, the user can control the open area of the pump body groove 2033 to achieve the user's desired air pressure supply to the inflatable body 200 (FIG. 1). The arrangement disclosed improves performance of the inflation assembly 2102 by controlling air pressure using a mechanical structure rather than stepless regulation of impeller rotation using an electrical circuit. The disclosed arrangement is stable with a simple structure and low cost, and the arrangement can be adapted to various electric air pumps and inflation assemblies to satisfy differing needs of inflatable products with differing inflation pressure requirements.

Figure 20:
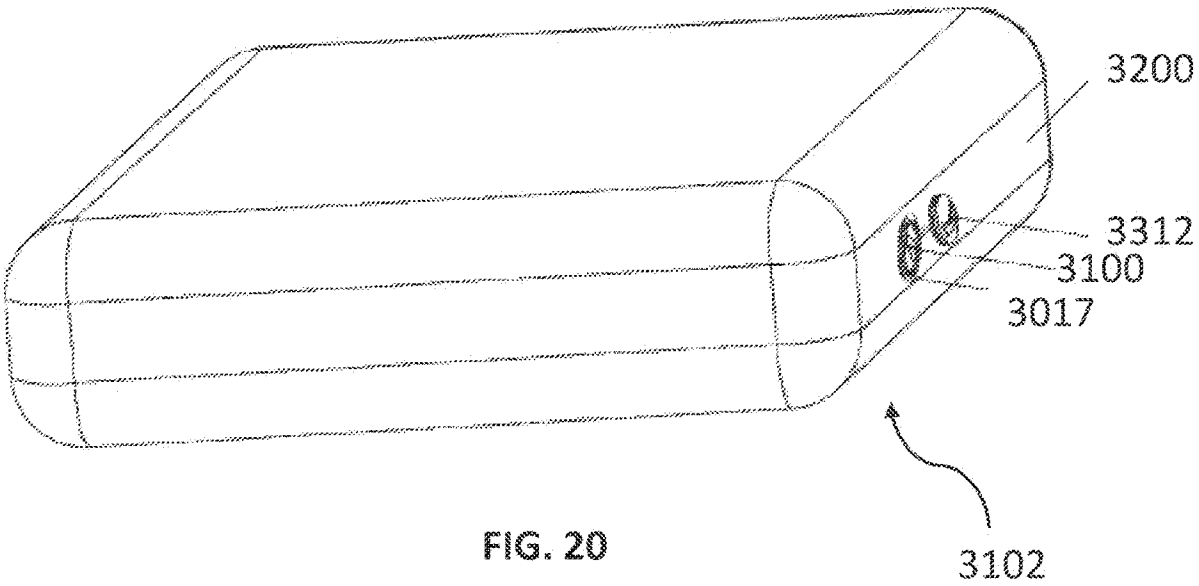
FIG. 20 illustrates an inflatable body, such as an air mattress, comprising another exemplary air pump inflation system, the air pump inflation system including a removable pump assembly.

Beginning with FIG. 20, in another embodiment, components of an inflation assembly 3102 are disclosed. The inflation assembly 3102 is substantially the same as the inflation assemblies 102, 1102, 2102 except as further described herein, wherein like components are like-numbered with the addition of "3000" added to the original reference number.

Referring to FIG. 20, an inflatable body 3200 is illustrated, the inflatable body 3200 coupled with an inflation assembly 3102. The inflation assembly 3102 includes a fixing ring 3017 disposed on a sidewall of the inflatable body 3200, and a cover 3312 coupled to the fixing ring 3017 to seal the inflatable body 3200 when not in use. During inflation, as described further herein, the cover 3312 is opened and a pump assembly 3100 is inserted into and removably coupled to the fixing ring 3017. When inflation of the inflatable body 3200 is complete, the pump assembly 3100 may be removed and the inflatable body 3200 re-sealed using the cover 3312. The pump assembly 3100 may optionally remain installed on the fixing ring 3017 to maintain the seal of the inflatable body 3200.

Figure 21:
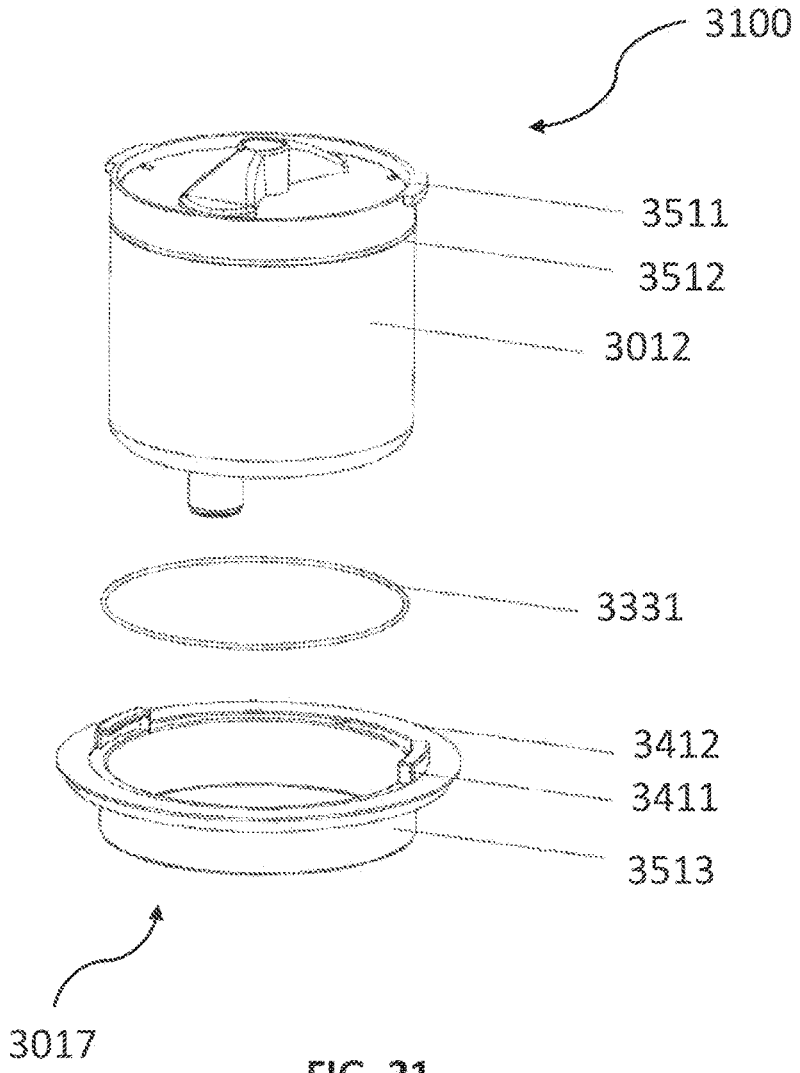
FIG. 21 is a partially exploded view of the pump inflation system of FIG. 20, wherein the air pump assembly of the inflation system is removable from a mounting assembly of the inflation system and shown in a detached configuration.

Now referring to FIG. 21, a partially exploded view of the pump assembly 3100 and the fixing ring 3017 is illustrated. A pump housing 3012 of the pump assembly 3100 includes at least one engagement tab 3511 extending outwardly from a sidewall of the pump housing 3012. Illustratively, the pump housing 3012 includes two engagement tabs 3511, although a greater number of engagement tabs 3511 may be utilized. The pump housing 3012 further comprises a groove 3512 configured to receive a seal 3331 (e.g., O-ring) to avoid leaks between the fixing ring 3017 and the pump housing 3012 when the pump assembly 3100 is coupled with the fixing ring 3017. In other embodiments, a greater number of seals 3331 may be used to facilitate a stronger seal between the pump housing 3012 and the fixing ring 3017. The fixing ring 3017 comprises a fixing ring seat 3412 and a fixing ring body 3413, which is coupled to the sidewall of the inflatable body 3200 (FIG. 20). Illustratively, the fixing ring 3017 is heat-welded to the inflatable body 3200, although other methods of coupling the fixing ring 3017 with the inflatable body 3200 may be contemplated (e.g., adhering, ultrasonic welding), provided the coupling forms a fluid-tight seal to avoid leaks from the inflatable body 3200.

A pair of engagement grooves 3411 are disposed on an upper surface of the fixing ring body 3413, each one of the engagement grooves 3411 configured to receive an engagement tab 3511 of the pump housing 3012 to facilitate coupling of the pump assembly 3100 with the fixing ring 3017. The number of engagement grooves 3411 provided on the fixing ring body 3413 corresponds with the number of engagement tabs provided on the pump housing 3012. In other embodiments, the pump housing 3012 and the fixing ring 3017 may be coupled using threaded fittings rather than a tab-and-groove coupling method.

Figure 22A:
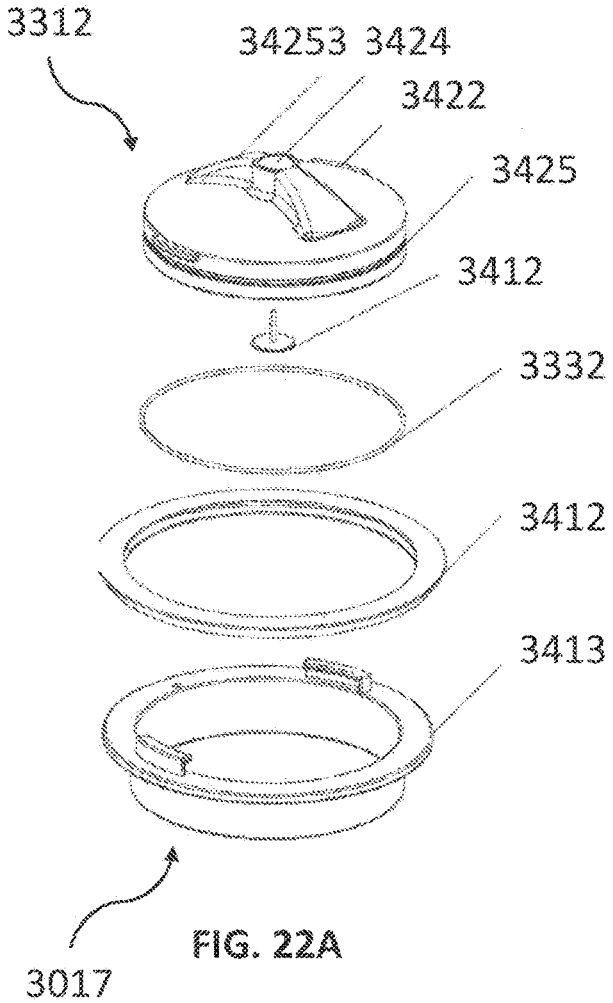
FIG. 22A is a partially exploded view of the pump inflation system of FIG. 20, wherein a cover of the inflation system is removable from a mounting assembly of the inflation system.
Figure 22B:
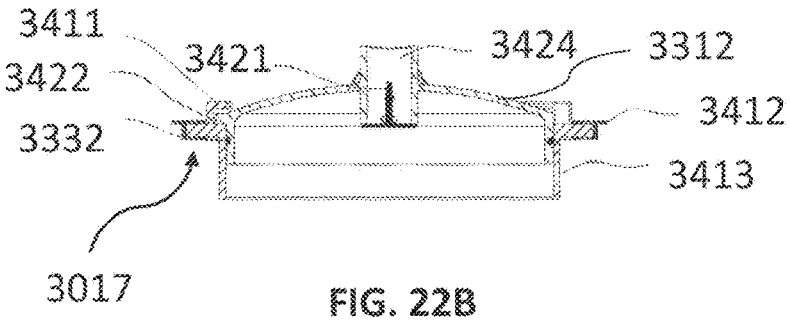
FIG. 22B is a cross-sectional view of the inflation system of FIG. 22A, wherein the cover and the mounting assembly are coupled without the pump assembly.

FIGS. 22A and 22B illustrate the interaction between the cover 3312 and the fixing ring 3017 when pump assembly 3100 is detached from the fixing ring 3017. The cover 3312 includes cover engagement tabs 3422 extending outwardly from the cover 3312 and configured to engage with the engagement grooves 3411 of the fixing ring 3017. Thus, engagement grooves 3411 of fixing ring 3017 may interchangeably receive engagement tabs 3511 of pump housing 3012 when pump assembly 3100 is installed (FIG. 21) and engagement tabs 3422 of cover 3312 when pump assembly 3100 is detached (FIG. 22A). The cover 3312 also includes a perimeter groove 3425 configured to receive a seal 3332 (e.g., O-ring) to facilitate a fluid-tight connection between the cover 3312 and the fixing ring 3017. The cover 3312 further includes a knob 3423 defining a vent 3424 with a valve 3421 positioned within the vent 3424. When assembled, the inflatable body 3200 (FIG. 20) may be inflated through the vent 3424 using an electric pump or a manual air pump.

Referring specifically to FIG. 22B, the coupling structure of the cover 3312 and the fixing ring 3017 is shown. The fixing ring seat 3412 forms a ring having an "h"-shaped cross section, while the fixing ring body 3413 forms a ring having an "L"-shaped cross section. The lateral structure of the fixing ring body 3413 is fixed in a space defined by the fixing ring seat 3412. In other embodiments, the fixing ring seat 3412 and the fixing ring body 3413 may comprise cross-sections of different shapes, including an I-shaped groove corresponding with a lateral extension.

Figure 23:
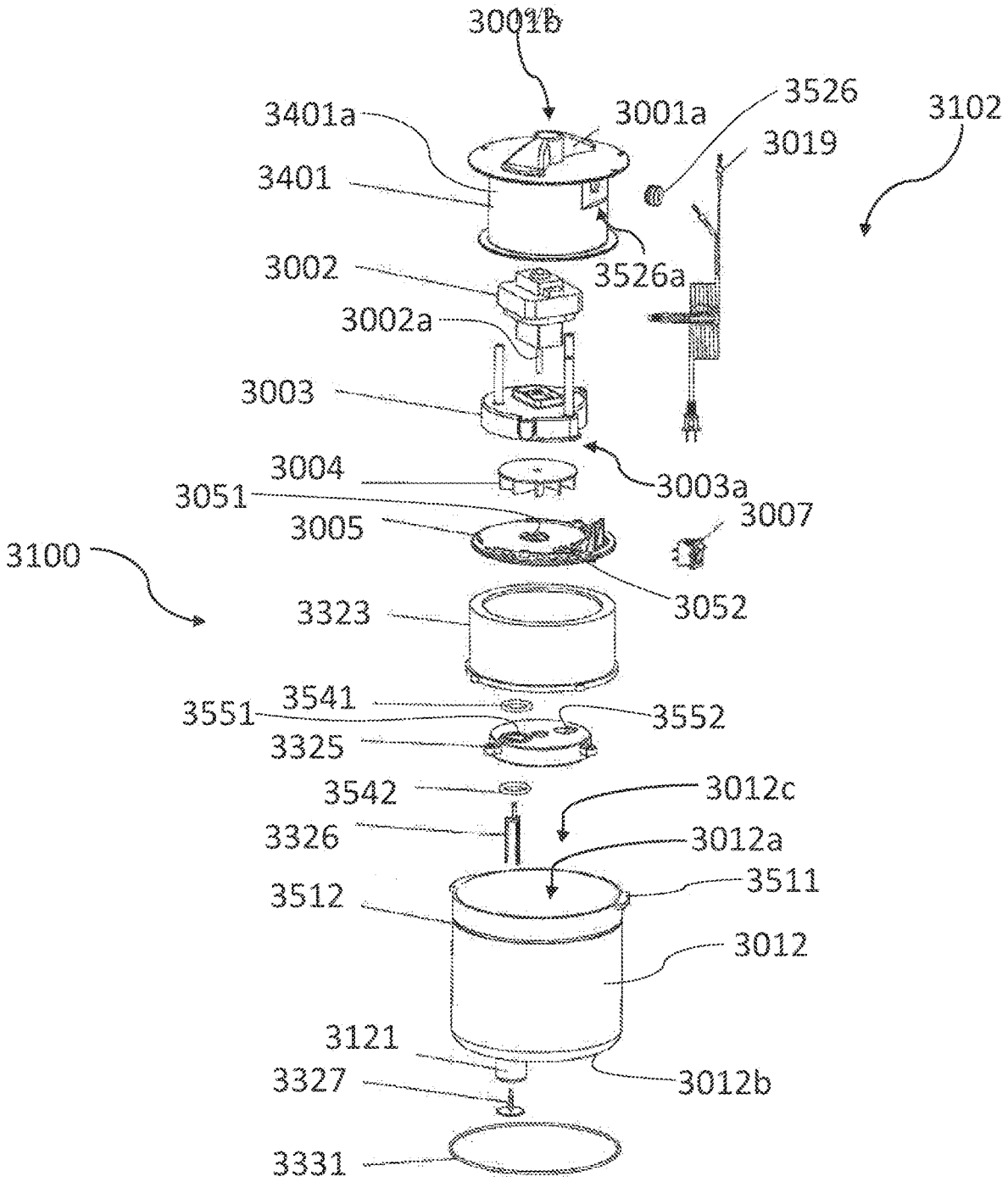
FIG. 23 is an exploded view of an air pump assembly of the inflation system of FIG. 20.

Now referring to FIG. 23, an exploded view of the pump assembly 3100 is provided. The housing 3012 of the pump assembly 3100 defines a chamber 3012*a* with a bottom surface 3012*b* and an opening 3012*c* opposite of the bottom surface 3012*b*. As discussed above, the housing 3012 includes engagement tabs 3511 for engaging with the fixing ring 3017 (FIG. 21) and a groove 3512 configured to receive a seal 3331. A vent port 3121 extends from the bottom surface 3012*b* of the housing 3012 and contains a one-way valve 3327 to mitigate or prevent unwanted leaks from the inflatable body 3200 (FIG. 20) into the chamber 3012*a* when inflated.

A stationary disc 3325 is disposed within the chamber 3012*a* and positioned above the vent port 3121 of the housing 3012. The stationary disc 3325 includes a first vent 3551 in communication with the vent port 3121. An ejector rod 3326 is illustratively positioned in the airway formed by the first stationary disc vent 3551 and the vent port 3121, and a seal 3542 may be positioned between the vent port 3121 and the first stationary disc vent 3551 to ensure a fluid-tight connection and mitigate or avoid air leaks. The stationary disc 3325 further defines a second vent 3552 to facilitate movement of air through the pump assembly 3100 as further described herein.

A pump body 3003 and a pump cover 3005 cooperate to form an impeller chamber 3003*a* configured to receive an impeller 3004. Once fitted together, the pump body 3003, the pump cover 3005, and the impeller 3004 are received by an upper casing 3323. The pump cover 3005 is disposed on the stationary disc 3325 and defines an air outlet 3051 and an air inlet 3052. Each of the air outlet 3051 and the air inlet 3052 are placed in selective communication with each of the first stationary disc vent 3551 and the second stationary disc vent 3552 during operation of the pump assembly 3100. A seal 3541 may be positioned between the pump cover 3005 and the stationary disc 3325 to ensure a fluid-tight connection between the pump cover 3005 and the stationary disc 3325 and mitigate the possibility of air leaks between the components. A motor 3002 is received within the chamber formed between the upper casing 3323 and a rotary assembly 3401, the motor 3002 being disposed on the pump body 3003 and including a rotational motor shaft 3002*a*, which extends through the pump body 3003 to engage with the impeller 3004.

The rotary assembly 3401 is provided to cooperate with the upper casing 3323 to house the motor 3002, the pump body 3003, the pump cover 3005, and the impeller 3004, which are rotatably received within the rotary assembly 3401 and the upper casing 3323. The pump body 3003 includes a plurality of connection columns 3031 which are configured to couple with the rotary assembly 3401 to provide synchronized rotation of the rotary assembly 3401, the pump body 3003, and the pump cover 3005. A knob 3001*a* is disposed on a top surface of the rotary assembly 3401, the knob 3001*a* defining a vent 3001*b* to allow passage of air between the chamber 3012*a* and the ambient air surrounding the inflation assembly 3102. The rotary assembly 3401 further includes an aperture 3526*a* defined by a sidewall 3401*a* of the rotary assembly 3401, which is configured to receive a cord clamp 3526. A power cord 3019 passes through the cord clamp 3526 to operatively couple to the motor 3002 positioned inside the rotary assembly 3401, wherein unused length of the power cord 3019 is selectively wound around the rotary assembly 3401. A switch 3007 is fixedly coupled to the pump cover 3005 to selectively operate the pump assembly 3100 at the desire of a user.

The structure of the pump assembly 3100 provides the rotary assembly 3401 to select airway configurations and retain control over the motor 3002 during rotation of the pump assembly 3100 between configurations. The rotary assembly 3401 and the upper casing 3323 rotatably and retractably cooperate to control the selection of various airway configurations, and additionally cooperate to form a gap in which the power cord 3019 can be stored.

Figure 24:
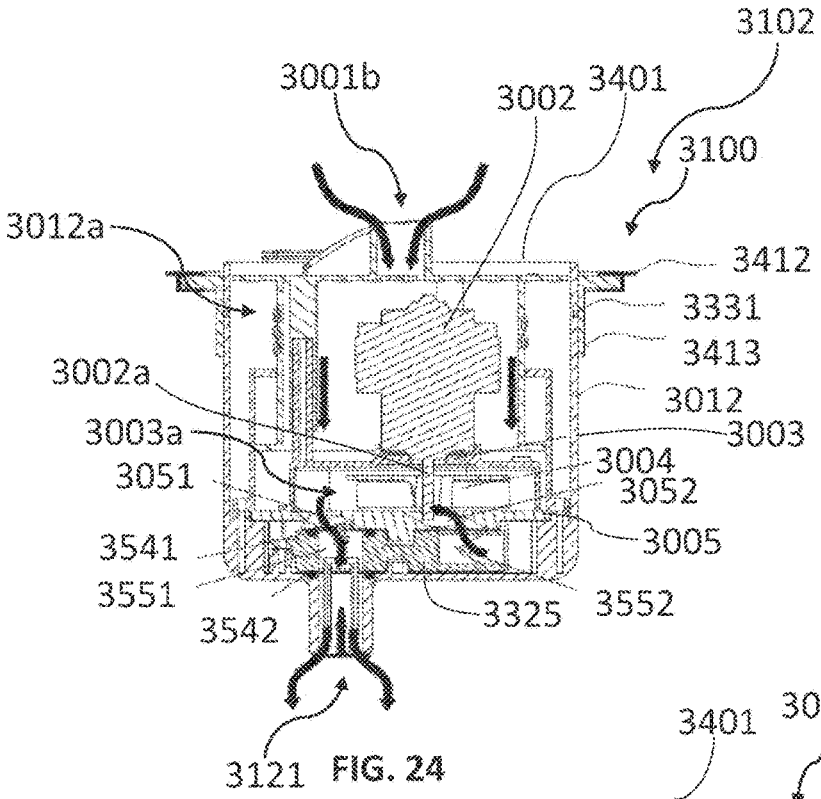
FIG. 24 is a cross-sectional view of the air pump assembly of FIG. 23, wherein the air pump assembly is shown in an inflation configuration.

Now referring to FIG. 24, a cross-section of the inflation assembly 3102 is illustrated in an inflation configuration. A user may place the inflation assembly 3102 into operation by actuating and/or rotating the rotary assembly 3401 to an inflation position, toggling the switch 3007 (FIG. 23) and causing the motor 3002 to begin to operate. Operation of the motor 3002 causes the impeller 3004 to rotate via the rotational motor shaft 3002*a*. With rotation of the impeller 3004, ambient air is drawn into the chamber 3012*a* via the knob vent 3001*b*. The air is then drawn into the impeller chamber 3003*a* through the second vent 3552 of the stationary disc 3325 and the inlet 3052 of the pump cover 3005, respectively. The air exits the impeller chamber 3003*a* through the outlet 3051 of the pump cover 3005 and the first vent 3551 of the stationary disc 3325, wherein the air is pumped into the inflatable body 3200 (FIG. 20) via the vent 3121.

Figure 25:
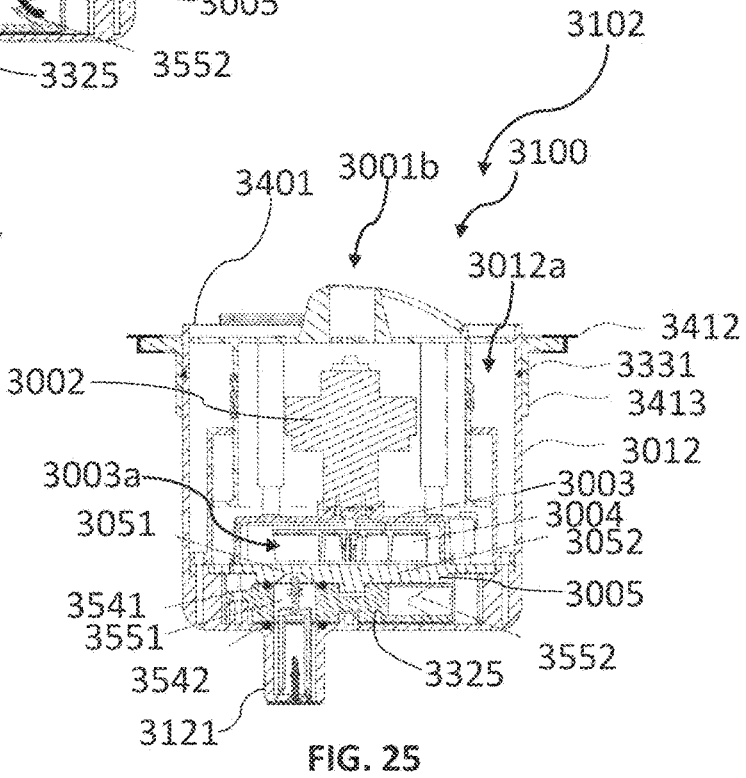
FIG. 25 is a cross-sectional view of the air pump assembly of FIG. 23, wherein the air pump assembly is shown in an off configuration.

Referring to FIG. 25, a cross-section of the inflation assembly 3102 is illustrated in an off configuration. As shown, the rotary assembly 3401 is rotated to an off position, so that the vent 3121 and the first vent 3551 ofthe stationary disc 3325 are blocked by the pump cover 3005 and neither the air outlet 3051 nor the air inlet 3052 of the pump cover 3005 is in contact with the first vent 3551 of the stationary disc 3325. In such a configuration, air cannot flow between the chamber 3012*a* of the pump assembly 3100 and the inflatable body 3200 (FIG. 20).

Figure 26:
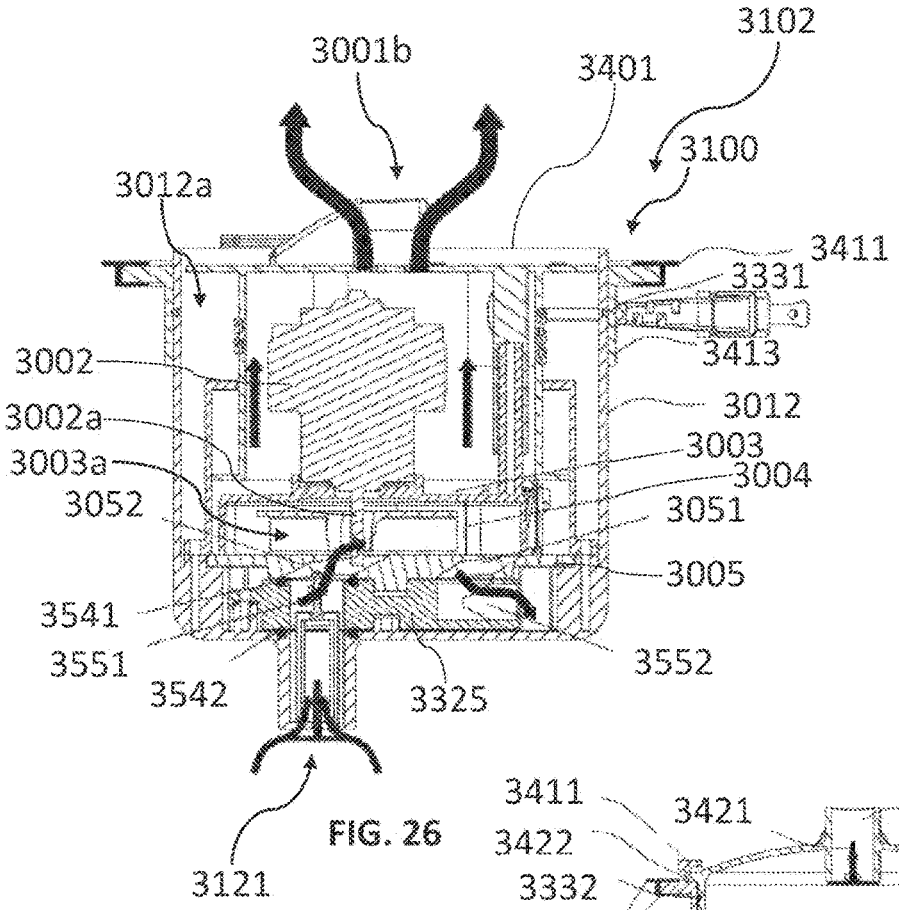
FIG. 26 is a cross-sectional view of the air pump assembly of FIG. 23, wherein the air pump assembly is shown in a deflation configuration.

FIG. 26 illustrates a cross-section of the inflation assembly 3102 in a deflation configuration. A user may place the inflation assembly 3102 into operation by actuating and/or rotating the rotary assembly 3401 to a deflation position, toggling the switch 3007 and causing the motor 3002 to begin to operate. Operation of the motor 3002 causes the impeller 3004 to rotate via the rotational motor shaft 3002*a*. With rotation of the impeller 3004, air from the inflatable body 3200 (FIG. 20) is drawn into the impeller chamber 3003*a* via the vent 3121, the first vent 3551 of the stationary disc 3325, and the air inlet 3052 of the pump cover 3005, respectively. The air exits the impeller chamber 3003*a* and enters the chamber 3012*a* through the air outlet 3051 of the pump cover 3005 and the second vent 3552 of the pump cover. The air is then pumped from the chamber 3012*a* and into the surrounding atmosphere via the knob vent 3001*b*.

Figure 27:
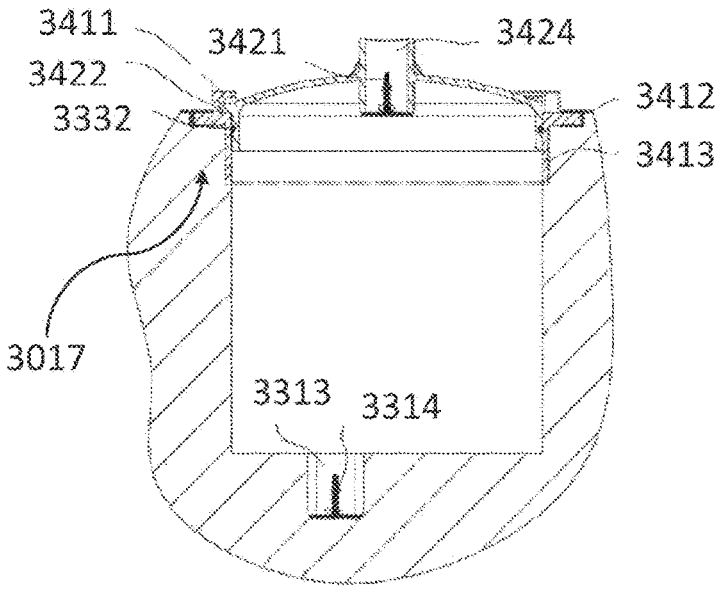
FIG. 27 is a cross-sectional view of the inflation system of FIG. 20, wherein the inflation system is shown without the air pump assembly and comprises an additional vent.

In another embodiment, as shown in FIG. 27, a second vent hole 3313 may be disposed between the inflatable body 3200 and the fixing ring 3017, the second vent hole 3313 generally corresponding to the port vent 3121 (FIG. 26) of the pump assembly 3100 (FIG. 26). The second vent hole 3313 may include a second one-way valve 3314 disposed within the second vent hole 3313. The distance between the upper surface of the fixing ring 3017 and the second one-way valve 3314 is illustratively less than the distance between the upper end surface of the pump assembly 3100 (FIG. 26) and the port vent 3121 (FIG. 26) in the same longitudinal direction. As such, the ejector rod 3326 may force the second one-way valve 3314 to open when the pump assembly 3100 is installed into the pump housing 3012, as described further below. The second vent hole 3313 and the second one-way valve 3314 provide extra mitigation against air leakage from the inflatable body 3200 when the pump assembly 3100 (FIG. 26) is removed, and the size configuration allows opening of the second one-way valve 3314 during inflation and deflation, ensuring operation of the pump assembly 3100.

In summary, the inflation assembly 3102 provides a removable pump assembly 3100 that may be replaced with the cover 3312 having a one-way valve 3421 to facilitate sealing of the inflatable body 3200 even without the presence of the pump assembly 3100. The one-way valve 3421 can further be used for manual inflation and deflation of the inflatable body 3200. A variety of inflation and deflation methods provided in a single package provides an improved user experience. Additionally, the structure of the inflation assembly 3102 is simple and easy to install, which reduces production and inflation costs.

Figure 28:
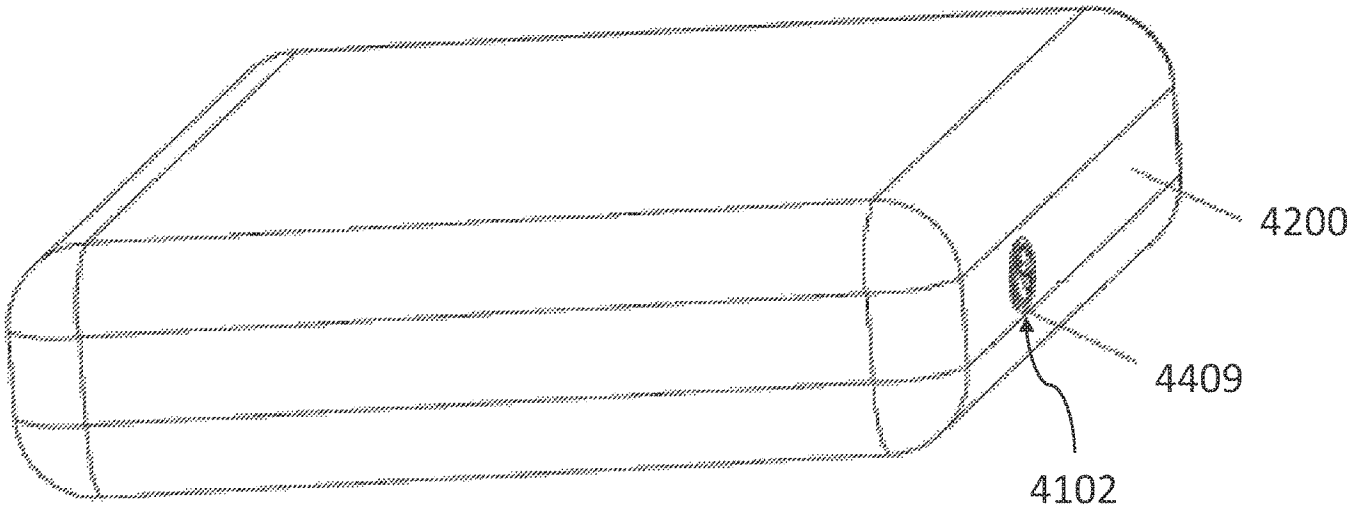
FIG. 28 illustrates an inflatable body, such as an air mattress, comprising yet another exemplary air pump inflation system the air pump inflation system including a removable pump assembly.

Beginning with FIG. 28, in another embodiment, components of an inflation assembly 4102 are disclosed. The inflation assembly 4102 is substantially the same as the inflation assemblies 102, 1102, 2102, 3102 except as further described herein, wherein like components are like-numbered with the addition of "4000" added to the original reference number.

As shown in FIG. 28, an inflatable body 4200 is illustrated, the inflatable body 4200 including an inflation assembly 4102. The inflatable body 4200 defines a cavity configured to receive a valve seat 4409 which is welded to the inflatable body 4200 and in communication with an interior chamber defined by the inflatable body 4200, as well as the exterior environment. A pump assembly 4100 is detachably coupled to the valve seat 4409. When inflation of the inflatable body 4200 is complete, the pump assembly 4100 may be attached, leaving the inflatable body 4200 sealed by a valve plug positioned inside the valve seat 4409. Such a structure eliminates the need to provide a one-way valve on the inflatable body 4200, which reduces the cost of production and increases the life of the inflatable body 4200 by removing an easily-damaged one-way valve.

Figure 29:
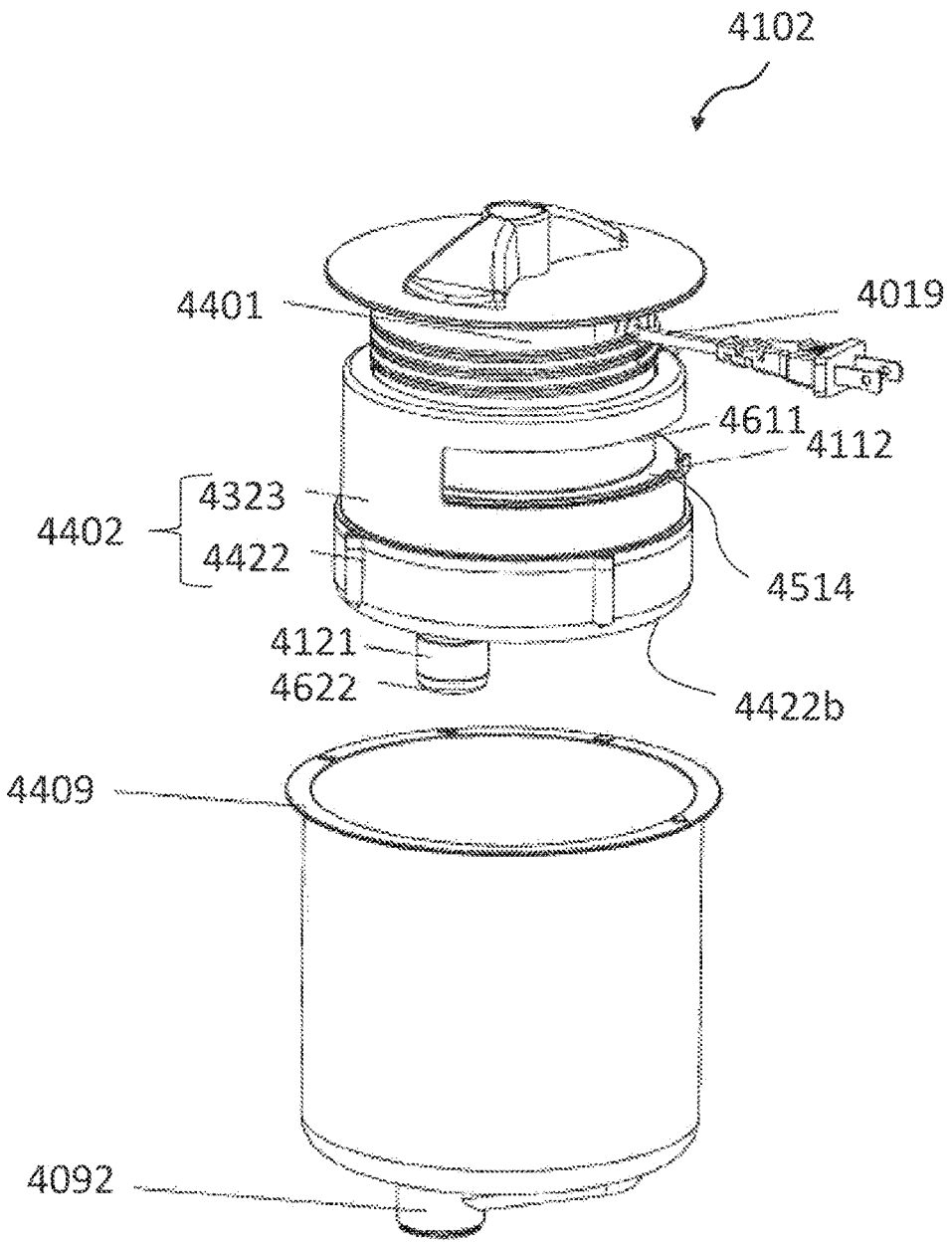
FIG. 29 illustrates a partially exploded view of the inflation system of FIG. 28, the inflation system showing the air pump assembly in a detached configuration relative to a mounting assembly.
Figure 30:
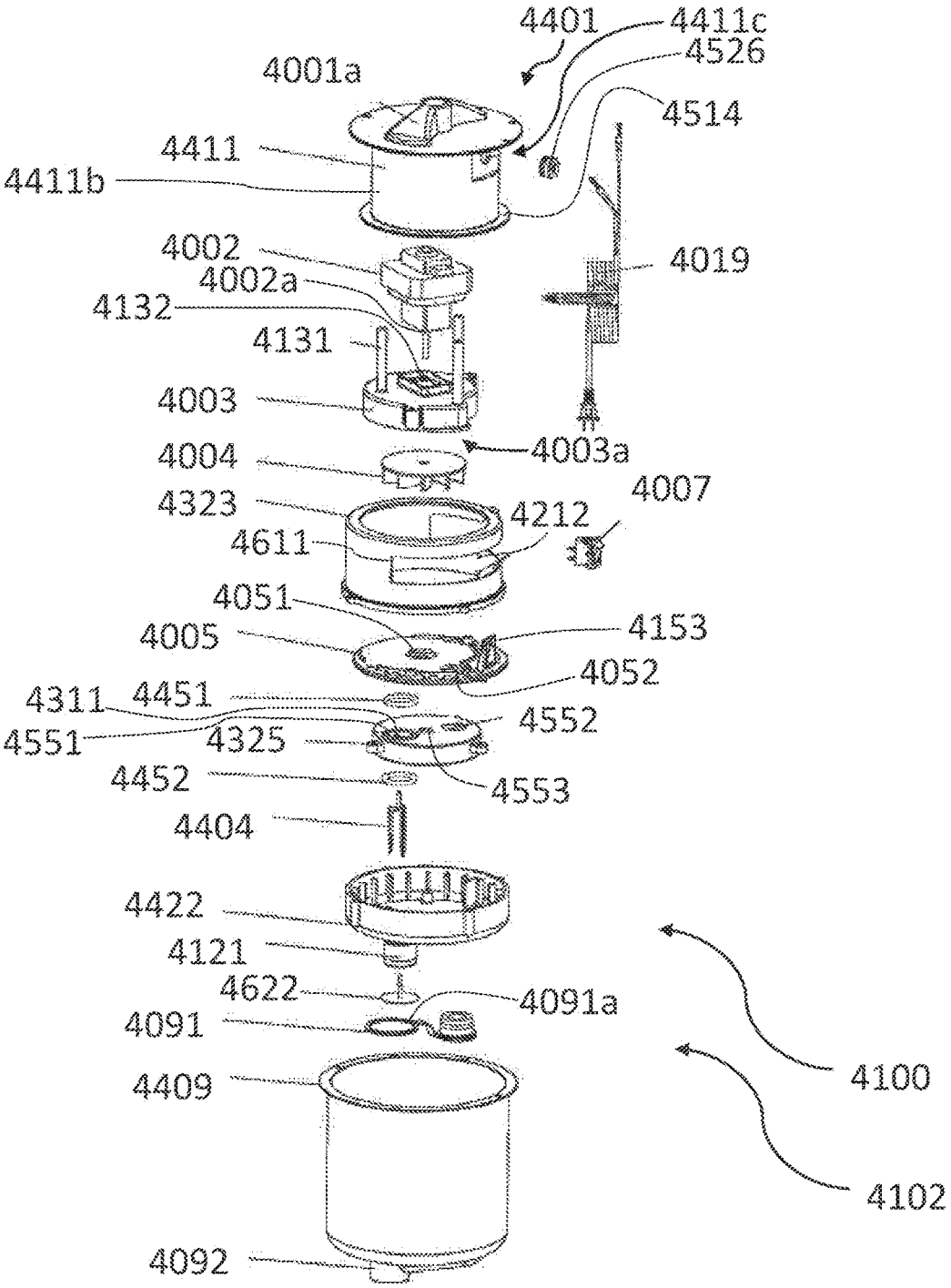
FIG. 30 illustrates an exploded view of the inflation system of FIG. 28.

Now referring to FIGS. 29-30, the inflation assembly 4102 is illustrated. The inflation assembly 4102 comprises a rotary assembly 4401, a casing 4402 comprising an upper casing 4323 and a lower casing 4422, and a power cord 4019. The rotary assembly 4401 is rotatably mounted within the upper casing 4323, wherein the power cord 4019 is wound around the rotary assembly 4401 within a gap defined by the rotary assembly 4401 and the upper casing 4323 when not in use. The upper casing 4323 defines a limiting window 4611, illustratively a half-ring rectangular groove, although other shapes, such as an oval groove, may be utilized. The rotary assembly 4401 includes a laterally protruding portion 4514 which is received by the limiting window 4611 when assembled. The laterally protruding portion 4514 includes a positioning stopper 4112 with an "L"-shaped structure that is configured to rotate within the limiting window 4611 but is limited in movement by the limiting window 4611 in both the horizontal and vertical directions. The positioning stopper 112 may include other structures, such as a columnar stopper.

A vent 4121 is disposed on a bottom surface 4422*b* of the lower casing 4422 with a one-way valve 4622 positioned within the vent 4121 to ensure that air will not leak from the inflatable body 4200 (FIG. 28) from the vent 4121 after inflation is completed, improving sealing performance and inflation efficiency. The valve seat 4409 is provided with a seat vent 4092 and a corresponding valve plug 4091. A connection portion 4091*a* of the valve plug 4091 is fixedly coupled to a boss formed by the seat vent 4092 inside the lower casing 4422, while the valve plug 4091 is received in a cavity in the bottom of the lower casing 4422 so that the seat vent 4092 is coupled to the vent 4121 for inflating the inflatable body 4200 (FIG. 28).

Specifically referring to FIG. 30, the rotary assembly 4401 includes a rotary casing 4411, a motor 4002, a pump body 4003, and a pump cover 4005. The pump body 4003 and the pump cover 4005 are fixedly coupled to form an impeller chamber 4003*a*, which is configured to receive an impeller 4004. An upper surface of the pump body 4003 defines a motor seat 4132 having an opening. The motor 4002 is positioned upon the motor seat 4132 so that a rotational motor shaft 4002*a* of the motor 4002 can pass through the opening to couple to the impeller 4004. Illustratively, the motor 4002 is fixedly coupled to the motor seat 4132 via a bolt, although other coupling methods, including other mechanical fasteners, may be utilized. A plurality of connecting posts 4131 extend from a top surface of the pump body 4003 to couple to a connecting seat on an inner cavity of the rotary casing 4411, so that the pump body 4003 is fixedly connected to the rotary casing 4411.

The pump cover 4005 defines an outlet 4051, an inlet 4052, and a switch bracket 4153 for mounting a switch 4007. The inner sidewall of the rotary casing 4411 comprises three stoppers 4212 positioned to trigger and/or turn off the switch 4007 upon rotation of the rotary assembly 4401. A stationary disc 4325 is disposed in and fixedly coupled to the lower inside surface of the lower casing 4422. The stationary disc 4325 defines a first vent 4551, a second vent 4552, and a groove 4553, wherein the second vent 4552 is positioned in a sidewall of the stationary disc 4325, and the first vent 4551 is in communication with the vent 4121. The pump cover 4005 is positioned just above the stationary disc 4325 and includes a boss extending therefrom, which corresponds with the groove 4553, resulting in rotation of the pump cover 4005 around the center of the groove 4553. A seal 4451 may be positioned between the pump cover 4005 and the stationary disc 4325 with a second seal 4452 positioned between the stationary disc 4325 and the lower casing 4422 to ensure fluid tightness between components. The pump body 4003 and the pump cover 4005, the stationary disc 4325 and the lower casing 4422, and the upper casing 4323 and the lower casing 4422 may be fixed via bolts, which is convenient for disassembly and assembly while ensuring structural stability. In other embodiments, other coupling mechanism may be used, such as buckles or other mechanical coupling means.

A knob 4001*a* is illustratively disposed on the top surface of the rotary casing 4411, the knob 4001*a* defining a knob vent 4001*b* to place the interior of the rotary casing 4411 in communication with the ambient air. A sidewall 4411*b* of the rotary casing 4411 is provided with an aperture 4411*c* and a corresponding cord clamp 4526, which receives at least a portion of a power cord 4019 so that the power cord 4019 may connect to the motor 4002 and the switch 4007 inside the rotary casing 4411.

Figure 31:
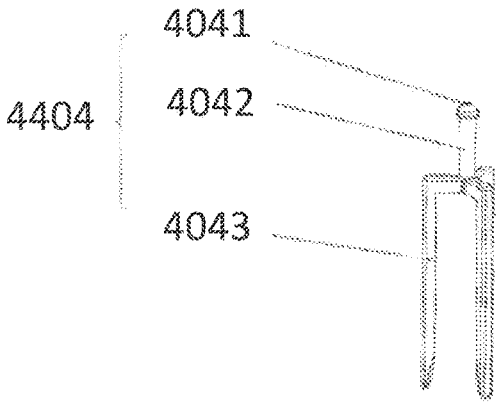
FIG. 31 illustrates an exemplary ejector rod for use with the inflation system of FIG. 28.

Now referring to FIG. 31, an exemplary ejector rod 4404 is disclosed. As shown, the ejector rod 4404 includes a connecting rod 4042, at least two side arms 4043, and a hemispherical head 4041. The ejector rod 4404 is positioned within the vent 4121 (FIG. 30), wherein the connecting rod 4042 is movably mounted on a ejector rod fixing ring 4311 (FIG. 30) positioned within the first vent 4551 (FIG. 30) of the stationary disc 4325 (FIG. 30) and is configured to open the one-way valve 4622 on the inflatable body 4200 (FIG.

28) or the pump assembly 4100 (FIG. 30) when the inflatable body 4200 is deflated so as to provide a smooth discharge.

Figure 32:
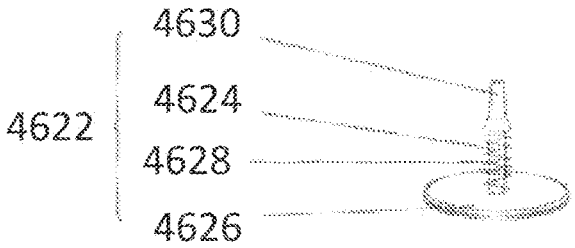
FIG. 32 illustrates an exemplary one-way valve for use with the inflation system of FIG. 28.

FIG. 32 illustrates an exemplary one-way valve 4622. As shown the one-way valve 4622 includes a valve rod 4624, a valve plate 4626 coupled to a first end of the valve rod 4624, and a spring 4628. At a second end of the valve rod 4624 opposite of the valve plate 4626, the valve 4622 includes a flange 4630, wherein the spring 4628 is disposed between the flange 4630 and the valve plate 4626. Such a configuration keeps the one-way valve in a closed state, improving the sealing performance of the pump assembly 4100 (FIG. 30) and the inflatable body 4200 (FIG. 28).

Figure 33:
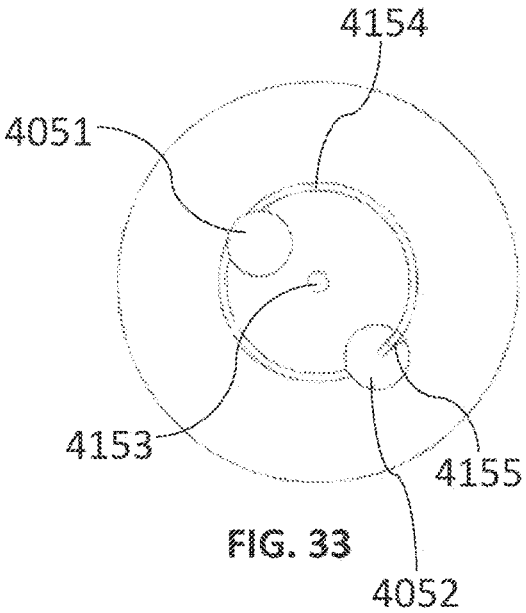
FIG. 33 illustrates a bottom view of a rotating pump cover for use with the inflation system of FIG. 28.

Referring to FIG. 33, a lower surface of the pump cover 4005 is illustrated. As shown and discussed above, the pump cover 4005 includes a boss 4153 configured to cooperate with the groove 4553 (FIG. 30) of the stationary disc 4325 (FIG. 30) so that the pump cover 4005 can rotate around the axis of the groove 4553. The pump cover 4005 further includes an annular groove 4154 configured to couple to the hemispherical head 4041 (FIG. 31) of the ejector rod 4404 (FIG. 31). As the pump cover 4005 rotates, the hemispherical head 4041 of the ejector rod 4404 moves in the annular groove 4154, and a stopper 4155 is located at a position where the annular groove intersects the inlet 4052. When the pump cover 4005 rotates until the inlet 4052 communicates with the first vent 4551 ofthe stationary disc 4325, the stopper 4156 pushes the ejector rod 4404 downward to open the one-way valve 4622 at the bottom of the vent 4121.

Figure 34:
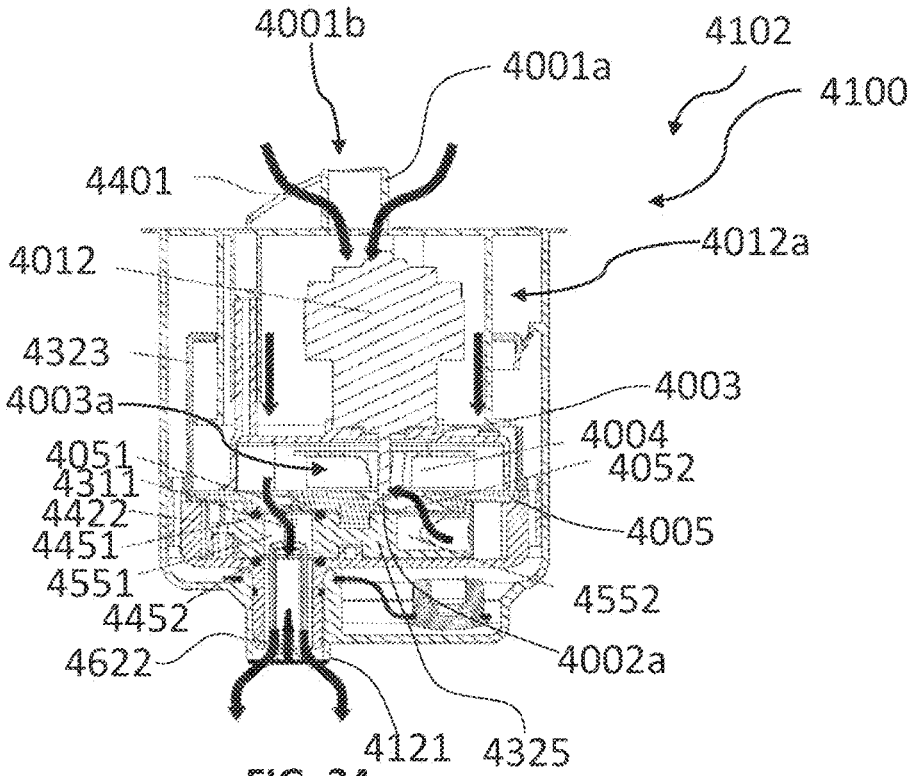
FIG. 34 is a cross-sectional view of the inflation system of FIG. 28, the inflation system shown in an inflation configuration.

Now referring to FIG. 34, a cross-section of the inflation assembly 4102 in an inflation configuration is provided. A user may place the pump assembly 4100 into operation by actuating or rotating the knob 4001*a* of the rotary casing 4411, resulting in the switch 4007 being triggered by a stopper 4212 on the inner wall of the rotary casing 4411 and placing the motor 4002 in an operational state. Operation of the motor 4002 causes the impeller 4004 to rotate via the rotational motor shaft 4002*a*. With rotation of the impeller 4004, ambient air is drawn into the pump assembly 4100 via the knob vent 4001*b*. The air is then drawn into the impeller chamber 4003*a* through the second vent 4552 of the stationary disc 4325, and the inlet 4052 of the pump cover 4005, respectively. The air exits the impeller chamber 4003*a* through the outlet 4051 of the pump cover, and the first vent 4551 of the stationary disc 4325, wherein the air is pumped into the inflatable body 4200 (FIG. 28) via the vent 4121.

Figure 35:
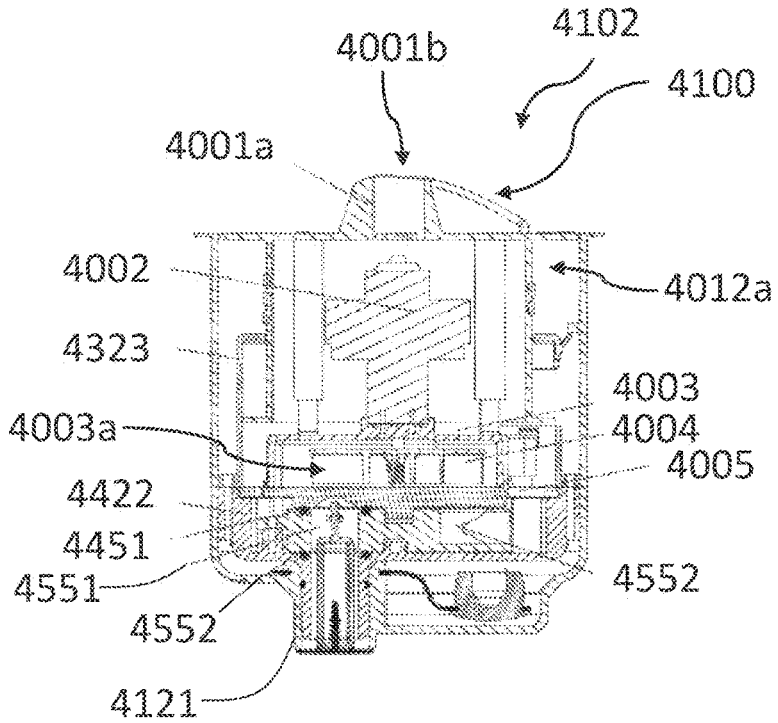
FIG. 35 is a cross-sectional view of the inflation system of FIG. 28, the inflation system shown in an off configuration.

FIG. 35 illustrates a cross-section of the inflation assembly 4102 in an off configuration. A user may place the pump assembly 4100 in the off configuration by actuating or rotating the knob 4001*a* of the rotary casing 4411, resulting in the switch 4007 being triggered by a stopper 4212 on the inner wall of the rotary casing 4411 and placing the motor 4002 in a non-operational state. In such a configuration, the vent 4121 and the first vent 4551 of the stationary disc 4325 are blocked by the pump cover 4005, and neither the outlet 4051 nor the inlet 4052 of the pump cover 4005 are in communication with the vent 4121. In such a configuration, air cannot flow between the pump assembly 4100 and the inflatable body 4200 (FIG. 28).

Figure 36:
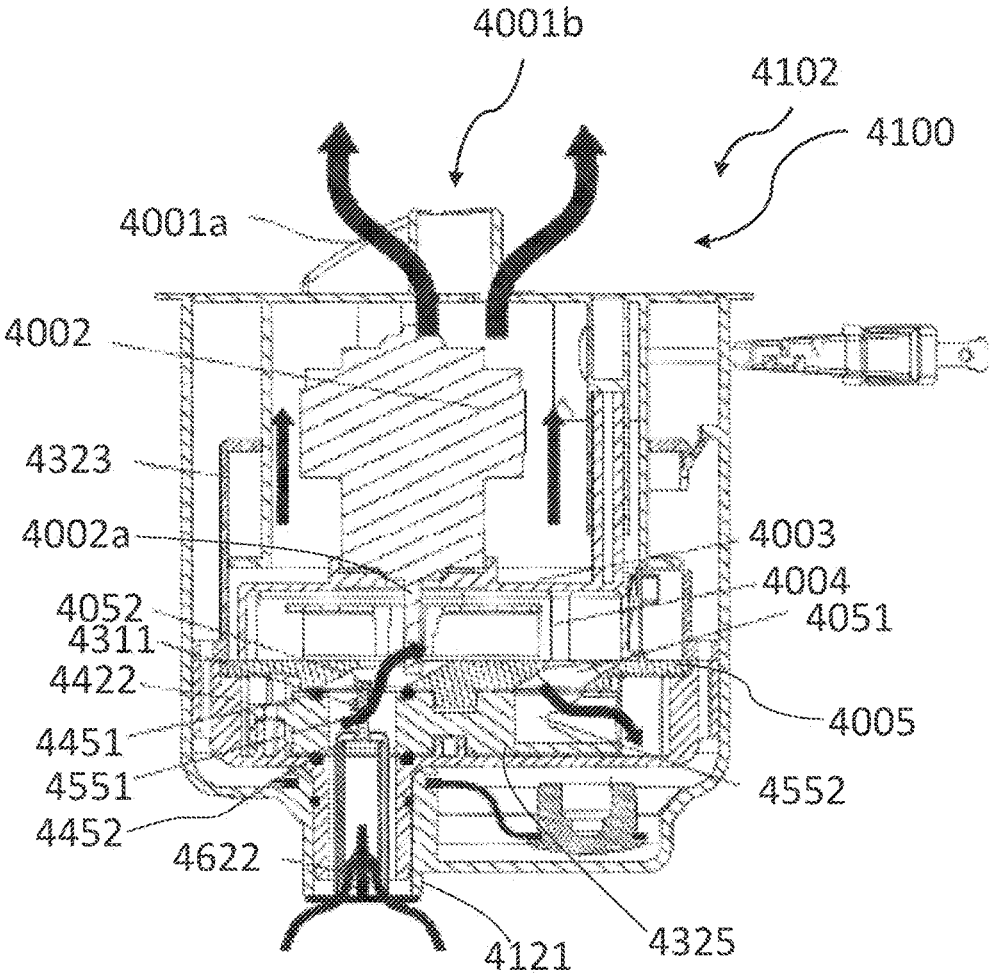
FIG. 36 is a cross-sectional view of the inflation system of FIG. 28, the inflation system shown in a deflation configuration.

Now referring to FIG. 36, a cross-section of the inflation assembly 4102 in a deflation configuration is illustrated. A user may place the pump assembly 4100 in the deflation configuration by actuating or rotating the knob 4001*a* of the rotary casing 4411, resulting in the switch 4007 being triggered by a stopper 4212 on the inner wall of the rotary casing 4411 and placing the motor 4002 in an operational state. Operation of the motor causes the impeller 4004 to rotate via the rotational motor shaft 4002*a*. The ejector rod 4404 is pushed away by the stopper 4156 (FIG. 33) provided in the inlet 4052 of the pump cover 4005, placing the one-way valve 4622 in an open state. With rotation of the impeller 4004, air from the inflatable body 4200 (FIG. 28) is drawn into the impeller chamber 4003*a* via the vent 4121, the first vent 4551 of the stationary disc 4325, and the inlet 4052 of the pump cover 4005, respectively. The air then exits the impeller chamber 4003*a* and enters the pump assembly 4100 via the outlet 4051 of the pump cover 4005 and the second vent 4552 of the stationary disc 4325. The air is then pumped from the pump assembly 4100 and into the surrounding atmosphere via the knob vent 4001*b*.

The ejector rod 4404 and the ejector rod trigger mechanism provided on the pump cover 4005 allows the inflatable body 4200 to communicate with the pump assembly 4100 and facilitate deflation of the inflatable body 4200 even with the presence of a one-way valve 4622. By disposing the one-way valve 4622 in the pump assembly 4100, a one-way gaseous communication with the inflatable body 4200 can be achieved during the process of inflation. This use combined with the valve seat 4409 can improve the tightness of the inflation system 4102 while also sealing via the valve plug 4091 on the valve seat 4409. Only one one-way valve 4622 is necessary, reducing the manufacturing costs, extending the life of the inflatable body 4200, and providing advantages of a simple structure and easy installation.

While embodiments of the invention have been described as having exemplary designs, the embodiments of the present disclosure may be further modified within the spirit and scope of this disclosure. This application is therefore intended to cover any variations, uses, or adaptations of the disclosed embodiments using its general principles. For example, any components found in any of inflation assemblies 102, 1102, 2102, 3102, and 4102 may be implemented into any of the other described inflation assemblies, even where a specific component was not expressly described in relation to a certain inflation assembly.

What is claimed is:

1. A system for use with an inflatable product, the system comprising:

a pump assembly, the pump assembly further comprising:

a pump housing forming a pump housing chamber, the pump housing defining a first vent in communication with the inflatable product;

a control panel rotatably coupled to the pump housing, the control panel comprising a second vent in communication with the surrounding environment and the pump housing chamber;

a pump body disposed in the pump housing chamber and coupled to the control panel;

a pump cover disposed in the pump housing chamber, the pump cover coupled to the pump body, wherein the pump cover cooperates with the pump body to form an impeller chamber and comprises an air inlet and an air outlet in communication with the impeller chamber;

an impeller disposed within the impeller chamber;

a motor disposed within the pump housing and operable to operate the impeller, the impeller configured to direct air from the air inlet to the air outlet of the pump cover; and a disc disposed between the pump cover and the first vent of the pump housing, the disc comprising a third vent and a fourth vent, wherein at least one of:

the third vent is in communication with the first vent of the pump housing and in selective communication with the air inlet and the air outlet of the pump cover; and the third vent is in communication with the air inlet of the pump cover and in selective communication with the first vent of the pump housing; and a mounting assembly configured to selectively receive and couple to the pump assembly, the mounting assembly fixedly coupled to the inflatable product.

2. The system of claim 1, wherein the mounting assembly comprises a body defining a second chamber accessible by a second chamber opening, the second chamber comprising a fifth vent in communication with the inflatable product, a check valve positioned within the fifth vent.

3. The system of claim 2, wherein the fifth vent is configured to selectively receive a valve plug.

4. The system of claim 2, further comprising a cover coupled to the body and configured to selectively cover the second chamber opening.

5. The system of claim 2, wherein the second chamber is sized and shaped to receive at least a portion of a power cord, the power cord operably coupled to the motor.

6. The system of claim 1, wherein the mounting assembly comprises a fixing ring fixedly coupled to the inflatable product.

7. The system of claim 1, wherein the control panel, the pump body, the pump cover, and the disc are synchronically rotated to selectively place the pump assembly in an inflation configuration, a deflation configuration, or an off configuration.

8. A system for use with an inflatable product, the system comprising:

a pump assembly comprising a pump housing forming a pump housing chamber, the pump housing defining a first vent; and a mounting assembly coupled to the inflatable product, the mounting assembly comprising a fixing ring fixedly coupled to the inflatable product and a body coupled to the fixing ring, the body defining a pump assembly coupling portion and a second chamber, wherein:

the pump assembly coupling portion comprises a hollowed ring structure configured to detachably couple with the pump housing of the pump assembly; and the body defines a second vent positioned at a bottom surface of the second chamber, wherein a check valve is disposed within the second vent, and wherein the second vent is configured to be in fluid communication with the inflatable product separate from the first vent.

9. The system of claim 8, the mounting assembly further comprising a cover detachably coupled to an opening of the second chamber to provide selective access to the second chamber.

10. The system of claim 8, wherein the pump assembly further comprises:

a control panel rotatably coupled to the pump housing, the control panel comprising a third vent in communication with the surrounding environment and the pump housing chamber;

a pump body disposed in the pump housing chamber and coupled to the control panel;

a pump cover disposed in the pump housing chamber, the pump cover coupled to the pump body, wherein the pump cover cooperates with the pump body to form an impeller chamber and comprises a first air inlet and a first air outlet in communication with the impeller chamber;

an impeller disposed within the impeller chamber;

a motor disposed within the pump housing and operable to operate the impeller, the impeller configured to direct air from the air inlet to the air outlet of the pump cover; and a selection disc disposed between the first vent of the pump housing and the pump cover, the selection disc comprising a second air inlet in communication with the first air inlet of the pump cover and a second air outlet in communication with the first air outlet of the pump cover, wherein the second air inlet and the second air outlet are in selective communication with the first vent of the pump housing.

11. The system of claim 10, wherein the pump body comprises a flange, a switch pedestal fixedly coupled to the flange by a spring pin, and a switch coupled to the switch pedestal.

12. The system of claim 10, further comprising a knob disposed on the control panel, wherein the third vent is positioned within the knob.

13. The system of claim 8, wherein an inner wall of the pump assembly coupling portion of the body of the mounting assembly comprises a threaded spiral configured to cooperate with a threaded portion of an outer surface of the pump housing.

14. The system of claim 8, wherein an inner wall of the pump assembly coupling portion of the body of the mounting assembly defines at least one limit groove, the at least one limit groove configured to detachably couple to a tab disposed on an outer surface of the pump housing.

15. The system of claim 8, wherein the second chamber is sized and shaped to selectively receive at least a portion of a power cord, the power cord operably coupled to the pump assembly.

16. The system of claim 8, wherein the pump assembly further comprises:

a control panel rotatably coupled to the pump housing, the control panel comprising a third vent in communication with the surrounding environment and the pump housing chamber.

17. The system of claim 8, wherein the pump assembly further comprises:

a pump body rotatably disposed in the pump housing chamber.

18. The system of claim 8, further comprising a valve plug removably received in the second vent.

* * * * *